US009903395B2

(12) United States Patent
Neff et al.

(10) Patent No.: US 9,903,395 B2
(45) Date of Patent: Feb. 27, 2018

(54) PROPORTIONAL PRESSURE CONTROLLER WITH ISOLATION VALVE ASSEMBLY

(71) Applicant: MAC Valves, Inc., Wixom, MI (US)

(72) Inventors: Robert H. Neff, Bloomfield Village, MI (US); Matthew Neff, Birmingham, MI (US); Kevin C. Williams, Wixom, MI (US); Joseph Richardson, Milford, MI (US)

(73) Assignee: MAC Valves, Inc., Wixom, MI (US)

( * ) Notice: Subject to any disclaimer, the term of this patent is extended or adjusted under 35 U.S.C. 154(b) by 51 days.

(21) Appl. No.: 15/052,307

(22) Filed: Feb. 24, 2016

(65) Prior Publication Data

US 2017/0241450 A1 Aug. 24, 2017

(51) Int. Cl.

| | |
|---|---|
| ***F15B 13/044*** | (2006.01) |
| ***F15B 13/04*** | (2006.01) |
| ***F15B 13/042*** | (2006.01) |
| ***F15B 20/00*** | (2006.01) |
| *F15B 13/043* | (2006.01) |

(52) U.S. Cl.

CPC ..... *F15B 13/0405* (2013.01); *F15B 13/0426* (2013.01); *F15B 20/00* (2013.01); *F15B 13/0431* (2013.01); *F15B 2211/8855* (2013.01)

(58) Field of Classification Search

CPC ..... F15B 13/0405; F15B 13/0426; F15B 13/0482; F15B 13/0431; F15B 20/00; F15B 2211/8855; Y10T 137/87209; Y10T 137/87217; Y10T 137/87193; Y10T 137/87225; Y10T 137/87917

USPC .... 137/596.16, 596.17, 596.18, 596.14, 102, 137/613

See application file for complete search history.

(56) References Cited

U.S. PATENT DOCUMENTS 3,139,109 A * 6/1964 Ruchser ..... F15B 20/001 137/596.16
3,294,120 A * 12/1966 Ruchser ..... F15B 13/0405 137/596.16

(Continued)

FOREIGN PATENT DOCUMENTS

DE 102012021462 A1 4/2014
DE 102014010940 A1 1/2015

(Continued)

OTHER PUBLICATIONS

European Search Report from EP 17155159.1 issued by the EPO dated Sep. 27, 2017.

*Primary Examiner* — Mary McManmon
*Assistant Examiner* — Minh Le
(74) *Attorney, Agent, or Firm* — Harness, Dickey & Pierce, P.L.C.

(57) ABSTRACT

A proportional pressure controller includes a body having inlet, outlet, and exhaust ports. A fill valve communicates with pressurized fluid in the inlet port. A dump valve communicates with pressurized fluid from the fill valve. An inlet poppet valve opens by pressurized fluid through the fill valve. An exhaust poppet valve when closed isolates pressurized fluid from the exhaust port. An outlet flow passage communicates with pressurized fluid when the inlet poppet valve is open, and communicates with the outlet port and an exhaust/outlet common passage. An isolation valve assembly selectively isolates fluid flow to and from the inlet port or the exhaust port to achieve a zero pressure condition.

23 Claims, 12 Drawing Sheets

(56) References Cited

U.S. PATENT DOCUMENTS 3,804,120 A * 4/1974 Garnett ..... F15B 13/0433 137/625.64
4,266,466 A * 5/1981 Ziems ..... B62D 5/08 137/110
4,750,521 A * 6/1988 Teltscher ..... F15B 13/0405 137/625.26
4,754,693 A * 7/1988 Teltscher ..... F15B 13/0405 137/596.18
4,961,441 A * 10/1990 Salter ..... G05D 16/2053 137/14
5,024,248 A * 6/1991 Kubo ..... F15B 13/0405 137/596.14
5,443,087 A * 8/1995 Myles ..... G05D 16/2093 137/102
6,305,401 B1 * 10/2001 Uehara ..... G05D 16/2093 137/102
6,357,335 B1 * 3/2002 Lafler ..... B60T 13/683 91/459
6,584,999 B2 * 7/2003 Inayama ..... G05D 16/2093 137/102
6,779,541 B2 * 8/2004 Inayama ..... G05D 16/2093 137/102
7,735,518 B2 * 6/2010 Williams ..... F15B 13/0402 137/596.15
8,245,729 B2 * 8/2012 Zub ..... F15B 13/0402 137/625.66
8,291,934 B2 * 10/2012 Gehlhoff ..... F15B 11/006 137/596.15
8,333,218 B2 * 12/2012 Walsh ..... F15B 13/0431 137/596.16
8,960,217 B2 * 2/2015 Inagaki ..... F15B 5/006 137/596.18
9,637,099 B2 * 5/2017 Eidenschink ..... B60T 8/3605

FOREIGN PATENT DOCUMENTS

EP 2354562 A2 8/2011
JP S57170404 U 10/1982
JP S6469807 A 3/1989
WO WO-2015155786 A1 10/2015

* cited by examiner

PROPORTIONAL PRESSURE CONTROLLER WITH ISOLATION VALVE ASSEMBLY

FIELD

The present disclosure relates to proportional pressure controllers adapted for use in pneumatic systems and particularly to proportional pressure controllers with a isolation valve assembly.

BACKGROUND

This section provides background information related to the present disclosure which is not necessarily prior art.

Proportional pressure controllers often include main internal valves which are moved to permit a pressurized fluid to be discharged to a pressure controlled device. Such proportional pressure controllers regulate the operating pressure of the pressurized fluid at the pressure controlled device. The main valves are commonly repositioned using solenoids operators. This configuration increases weight and expense of the proportional pressure controller and requires significant electrical current to reposition the main valves.

Known proportional pressure controllers are also often susceptible to system pressure undershoot or overshoot. Due to the mass and operating time of the main valves, signals controlling the main valves to reduce or stop pressurized fluid flow to the pressure controlled device may occur too soon or too late to avoid either not reaching or exceeding the desired operating pressure. When this occurs, the control system operating the solenoid actuators begins a rapid opening and closing sequence as the controller "hunts" for the desired operating pressure. This rapid operation known as "motor-boating", increases wear and the operating costs associated with the proportional pressure controller.

Known proportional pressure controllers often include an inlet port, an outlet port, and an exhaust port. A high pressure fluid is typically supplied to the inlet port, after passing through the proportional pressure controller, the fluid exits to the pressure controlled device through the outlet port, and excess fluid pressure is vented from the proportional pressure controller through the exhaust port. Another problem associated with known proportional pressure controllers is that it is difficult to achieve zero pressure at the outlet port of the proportional pressure controller even when a zero pressure condition at the outlet port is desired. The inability to create zero pressure at the outlet port of the proportional pressure controller can negatively affect the operation and/or performance of the pressure controlled device.

SUMMARY

This section provides a general summary of the disclosure, and is not a comprehensive disclosure of its full scope or all of its features.

In accordance with one aspect of the subject disclosure, a proportional pressure controller is provided that minimizes the likelihood of having pressure at an outlet port of the proportional pressure controller when a zero pressure condition at the outlet port is desired. The proportional pressure controller generally includes a body, an inlet poppet valve, an exhaust poppet valve, a isolation valve assembly, and an actuator that controls the isolation valve assembly. The body of the proportional pressure controller has an inlet flow passage, an outlet flow passage, an exhaust/outlet common passage, and an exhaust flow passage. An inlet port in the body opens to the inlet flow passage, the outlet port in the body opens to the outlet flow passage and the exhaust/outlet common passage, and an exhaust port in the body opens to the exhaust flow passage. An inlet valve cavity in the body connects the inlet flow passage to the outlet flow passage and an exhaust valve cavity in the body connects the exhaust/outlet common passage to the exhaust flow passage. The inlet poppet valve is slidably disposed in the inlet valve cavity and the exhaust poppet valve is slidably disposed in the exhaust valve cavity. In operation, the inlet poppet valve controls fluid flow between the inlet flow passage and the outlet flow passage and the exhaust poppet valve controls fluid flow between the exhaust/outlet common passage and the exhaust flow passage.

The isolation valve assembly is integrated into the body of the proportional pressure controller. The isolation valve assembly generally includes an isolation valve cavity and a isolation valve member that is situated in the isolation valve cavity. The isolation valve cavity is disposed in the body in fluid communication with the outlet port. The isolation valve member is slidably disposed in the isolation valve cavity. In operation, the isolation valve member moves relative to and within the isolation valve cavity between a isolation valve closed position and an isolation valve open position. The actuator of the proportional pressure controller controls the movement of the isolation valve member between the isolation valve closed position and the isolation valve open position. In the isolation valve closed position, the isolation valve member prevents fluid from flowing through the outlet port in the body of the proportional pressure controller. By contrast, in the isolation valve open position, the isolation valve member permits fluid flow through the outlet port. Advantageously, this arrangement is compact and provides a zero pressure condition at the outlet port, which can be configured to connect to the pressure controlled device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
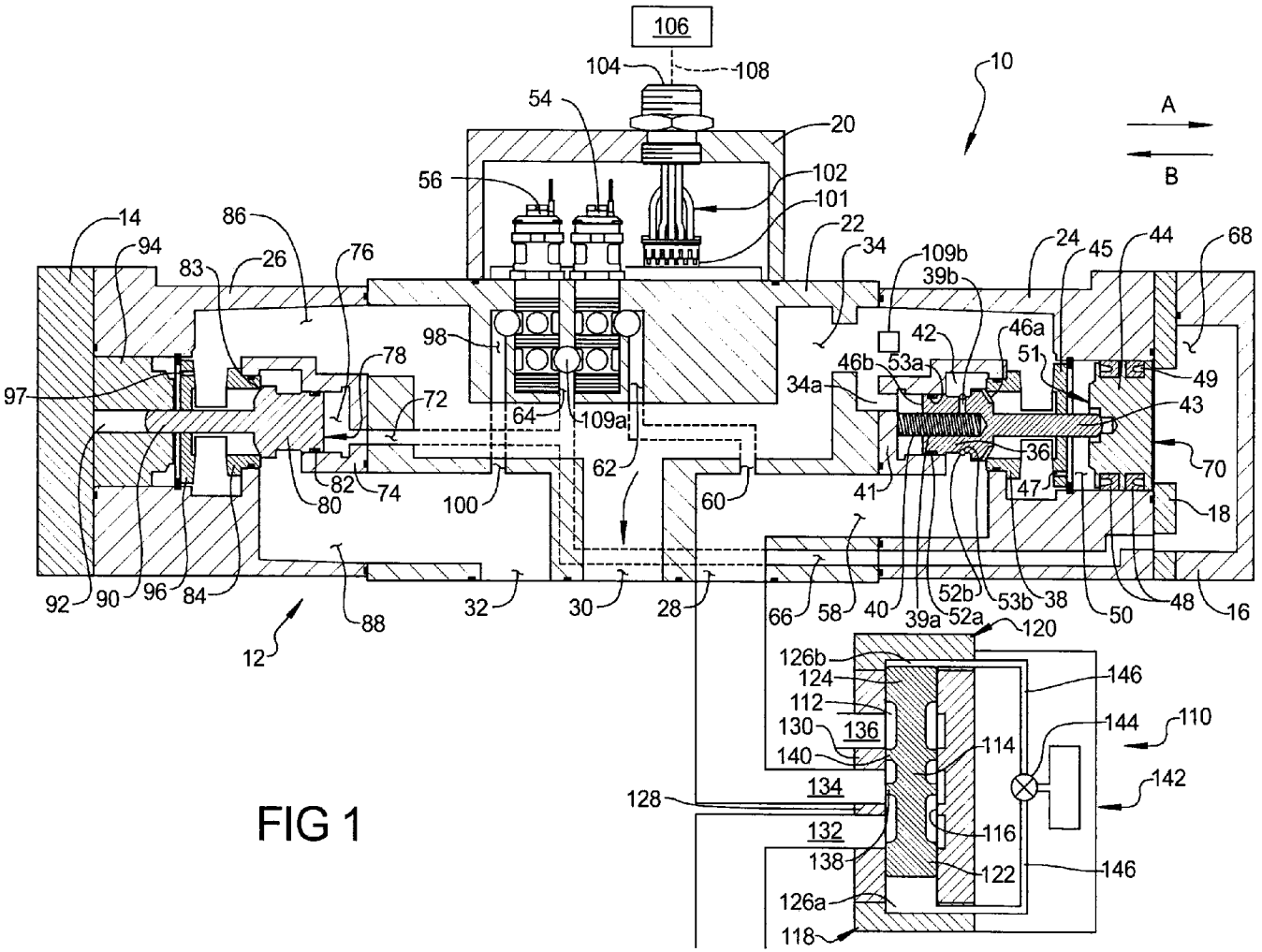
FIG. 1 is a side cross-sectional view of an exemplary proportional pressure controller constructed in accordance with the subject disclosure.
Figure 2A:
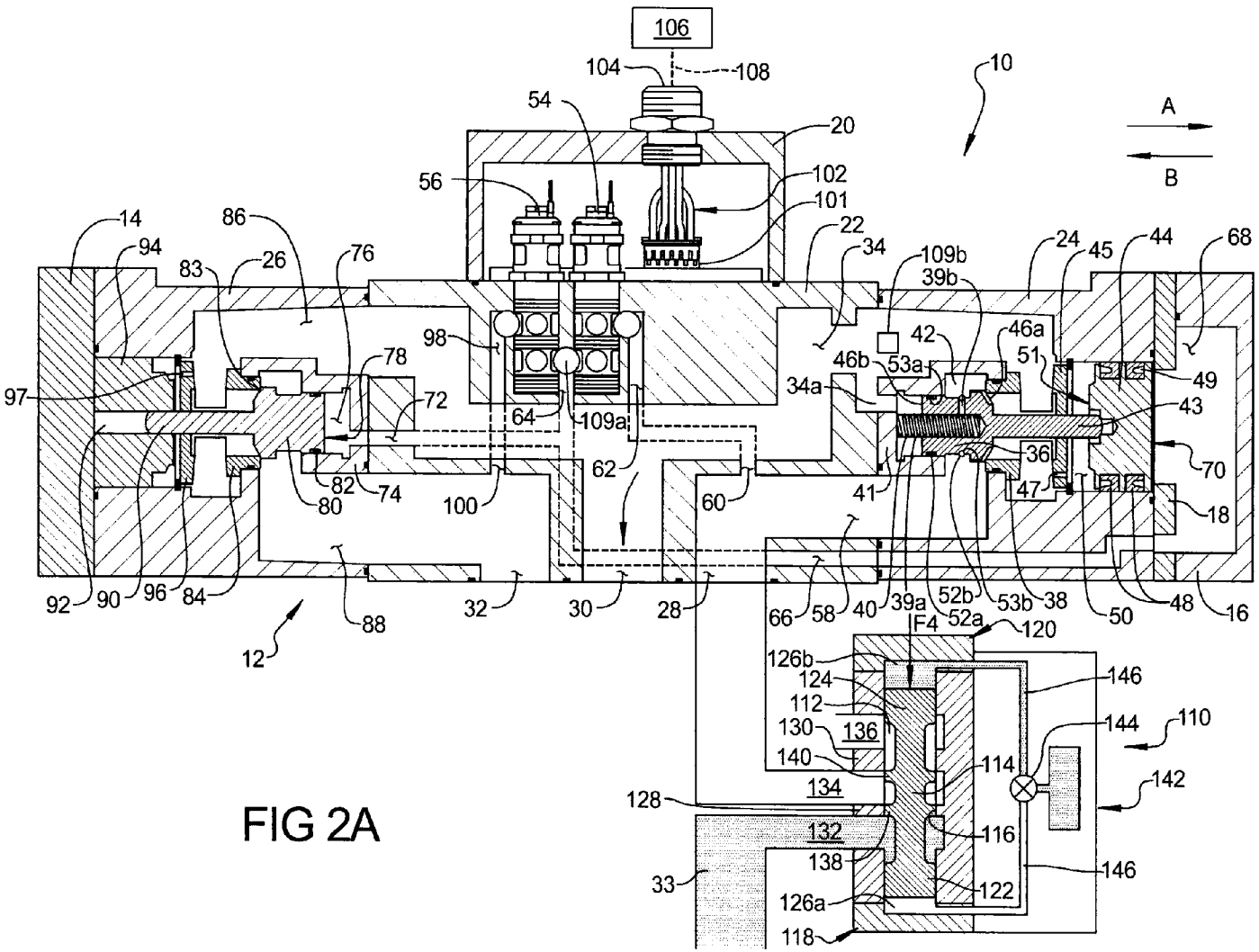
FIG. 2A is another side cross-sectional view of the exemplary proportional pressure controller of FIG. 1 where an exemplary isolation valve assembly is preventing fluid from entering an inlet port in a body of the exemplary proportional pressure controller.
Figure 2B:
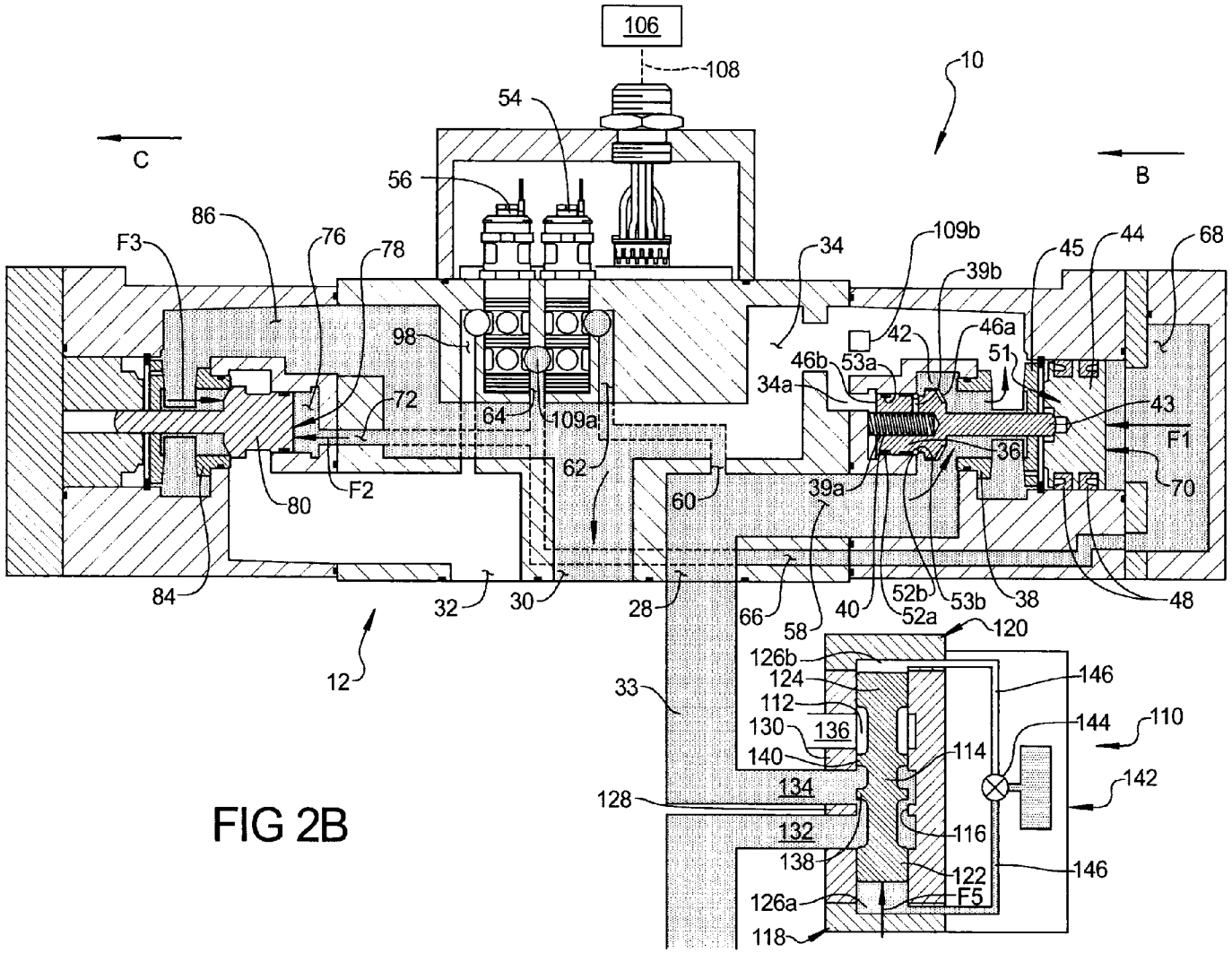
FIG. 2B is another side cross-sectional view of the exemplary proportional pressure controller of FIG. 1 where the exemplary isolation valve assembly is supplying the inlet port in the body of the exemplary proportional pressure controller with fluid and where fluid is being discharged through an outlet port in the body of the exemplary proportional pressure controller.
Figure 2C:
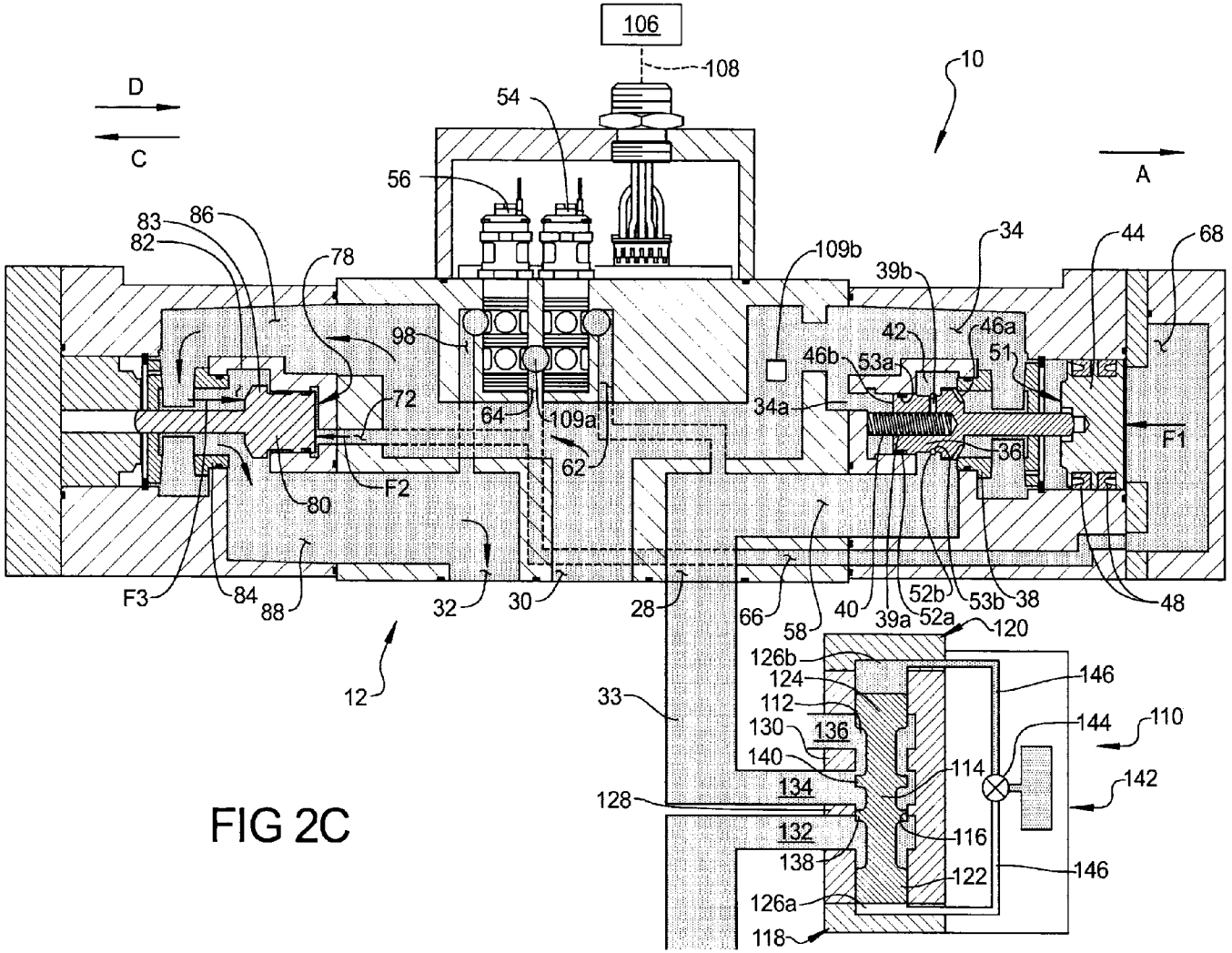
Figure 3:
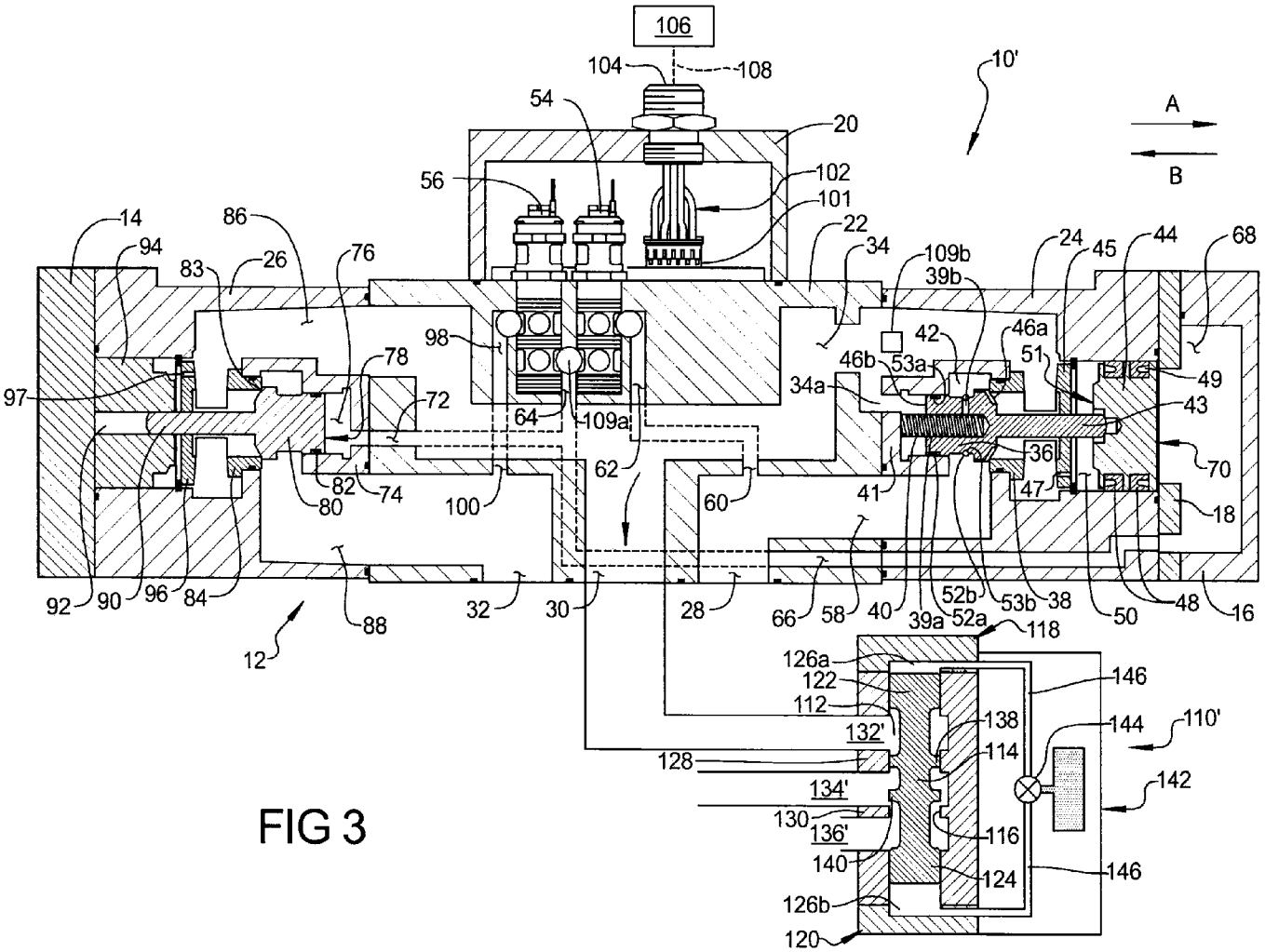
Figure 4A:
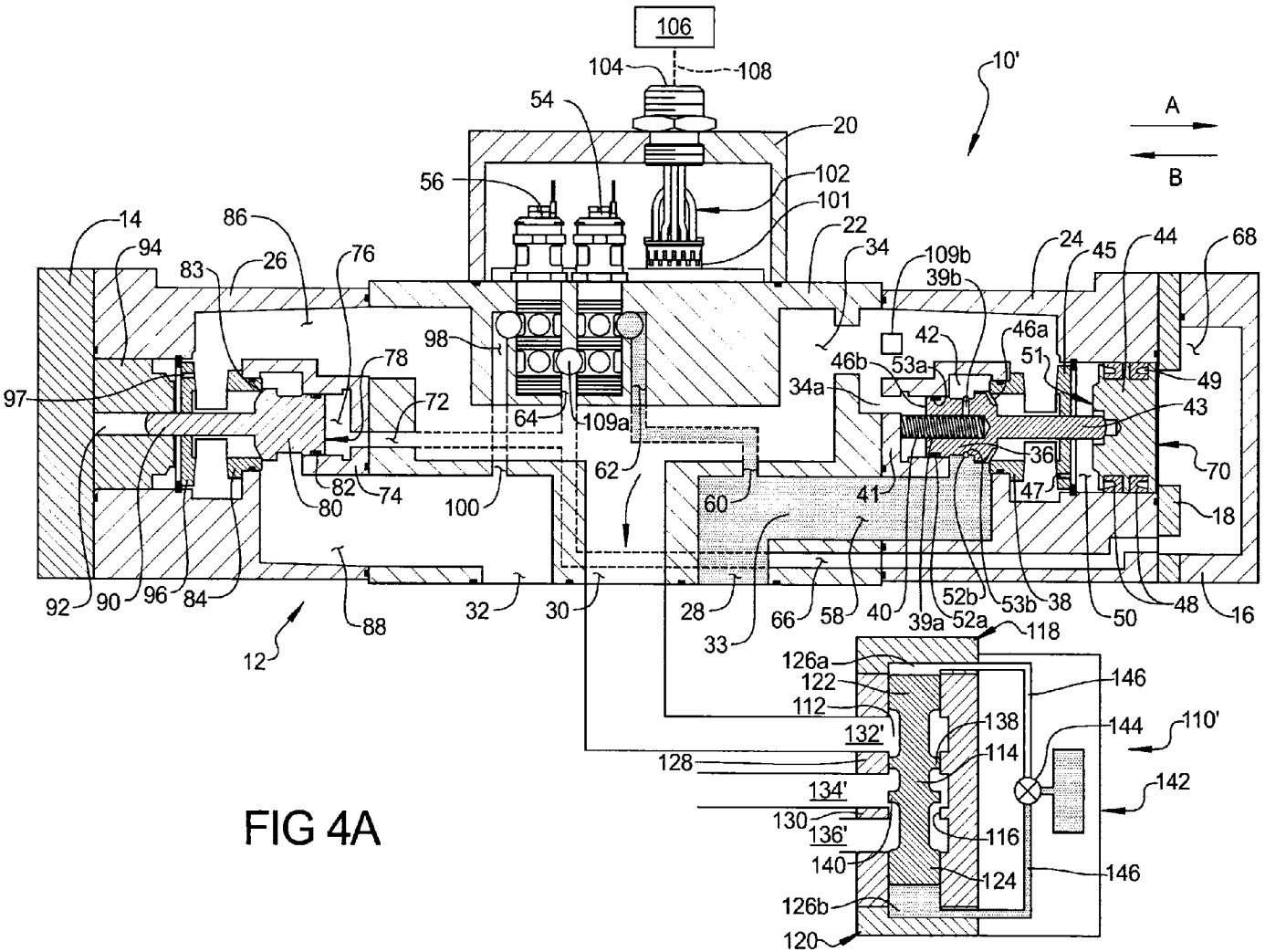
Figure 4B:
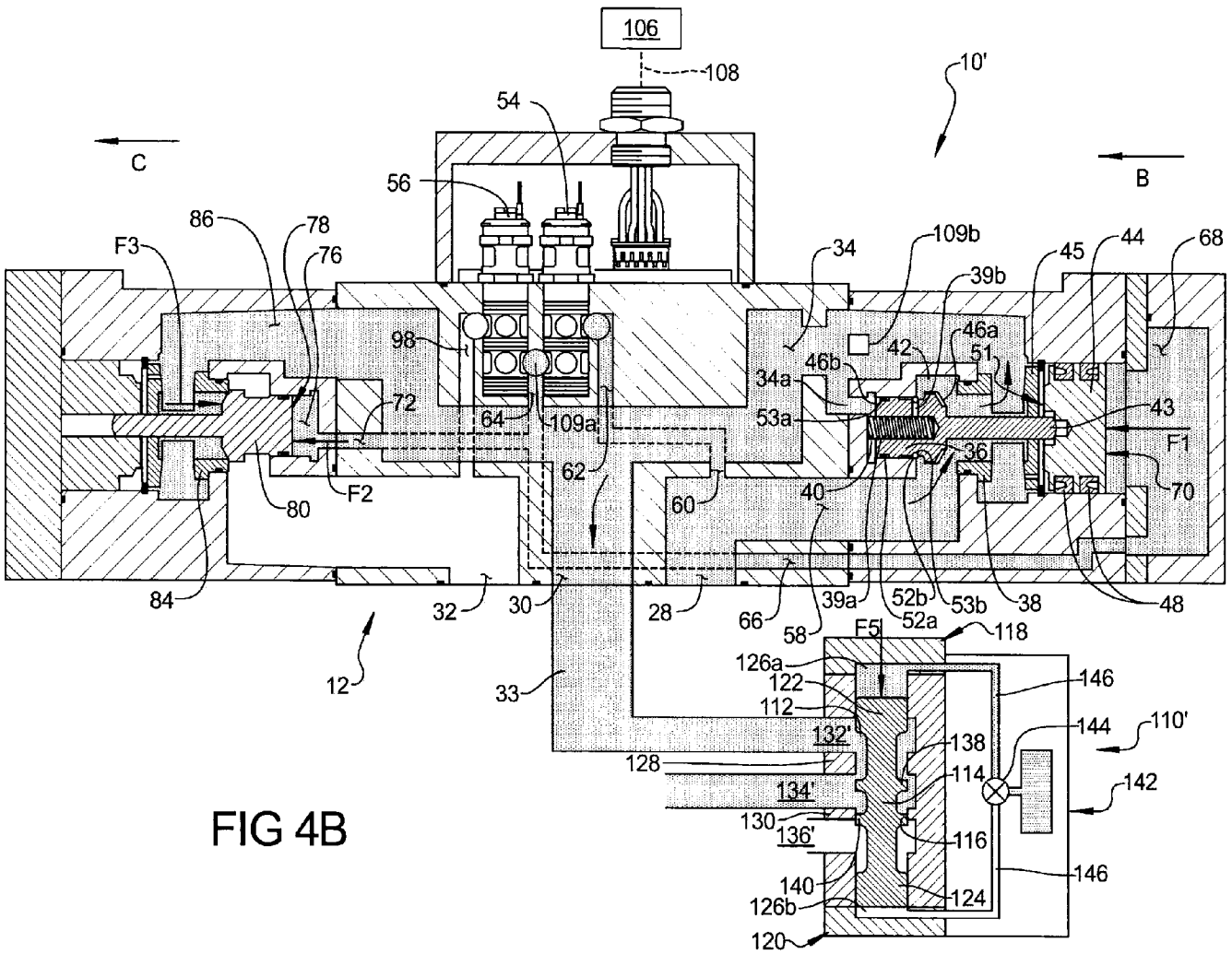
Figure 4C:
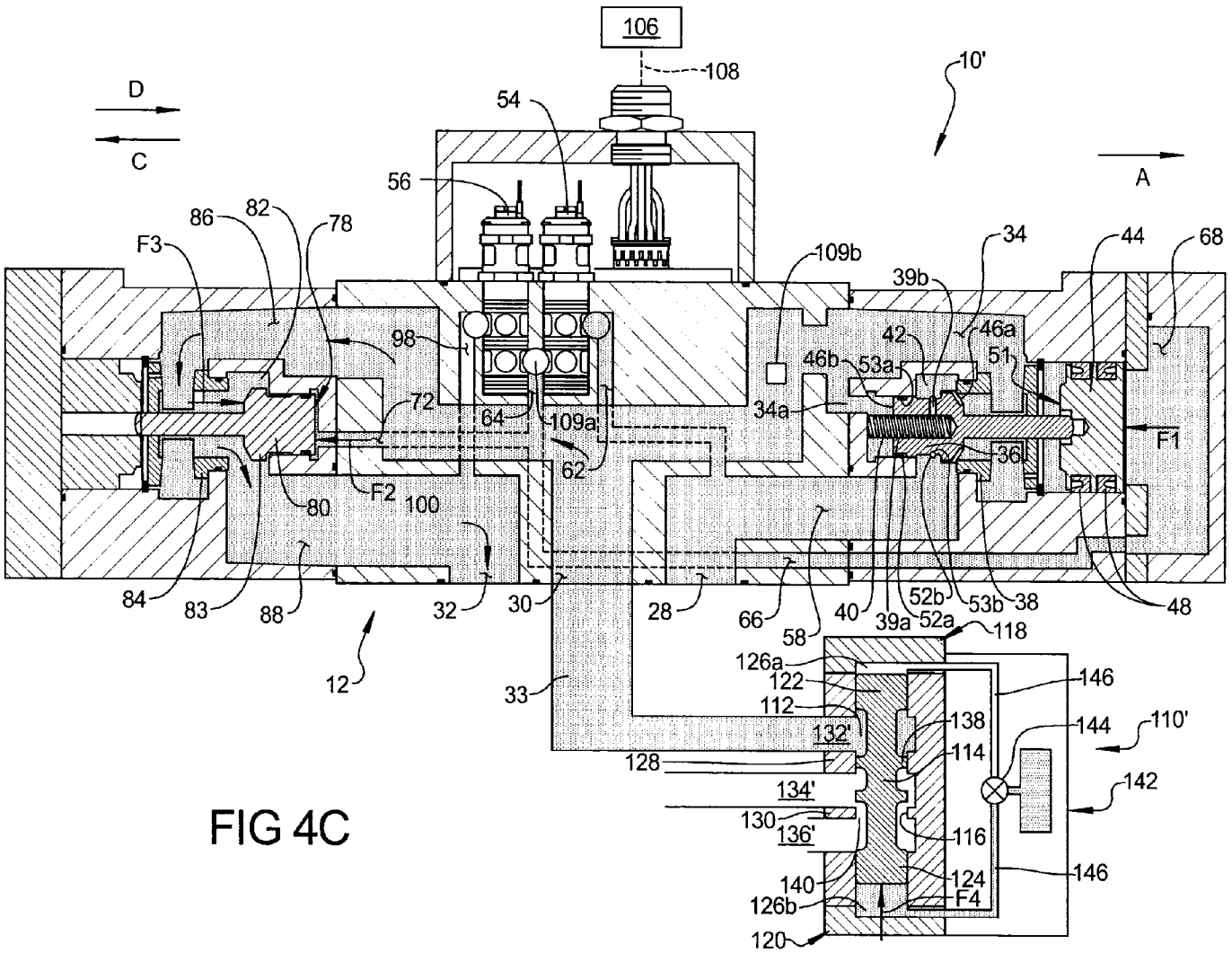
Figure 5:
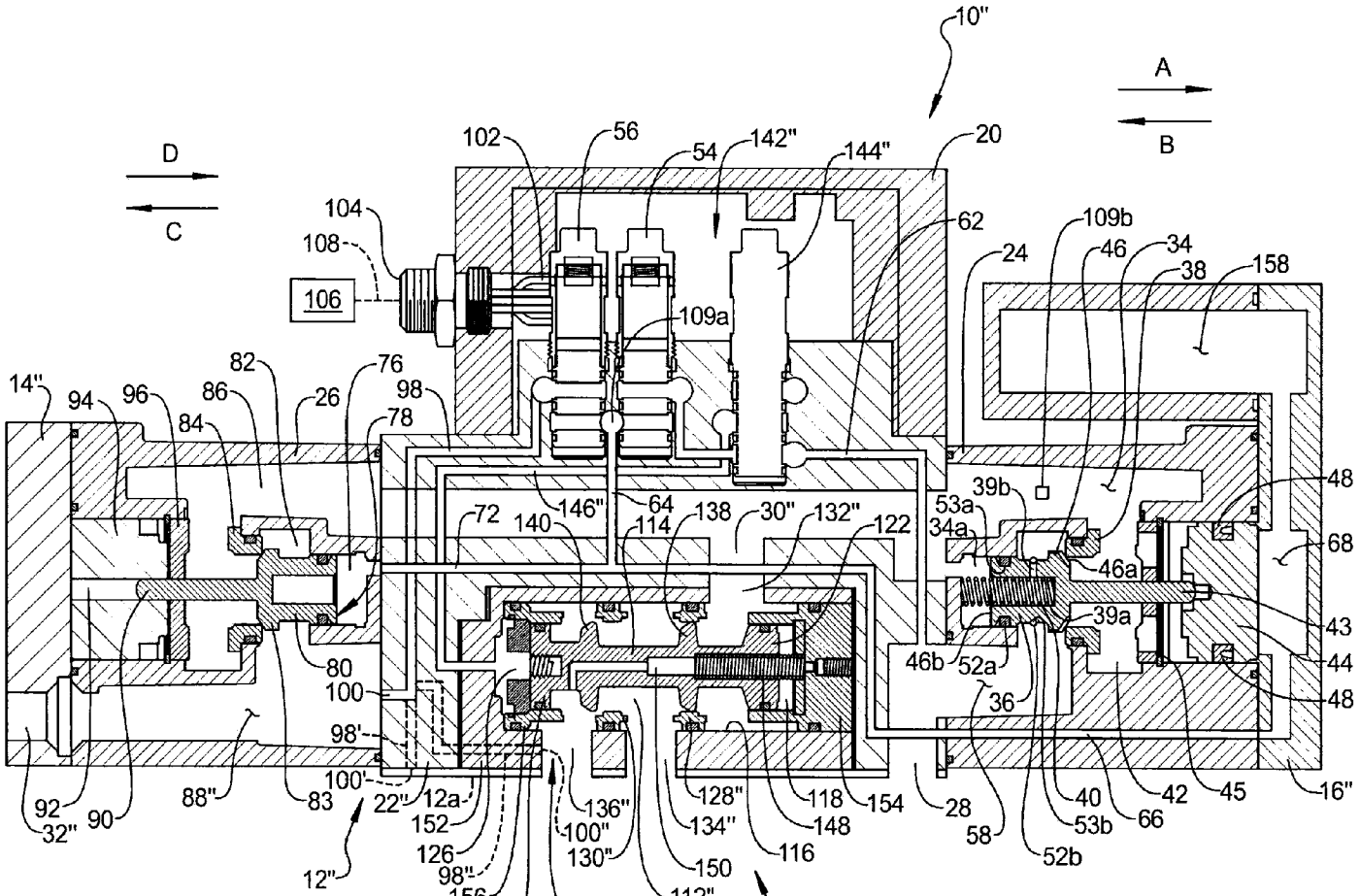
Figure 6A:
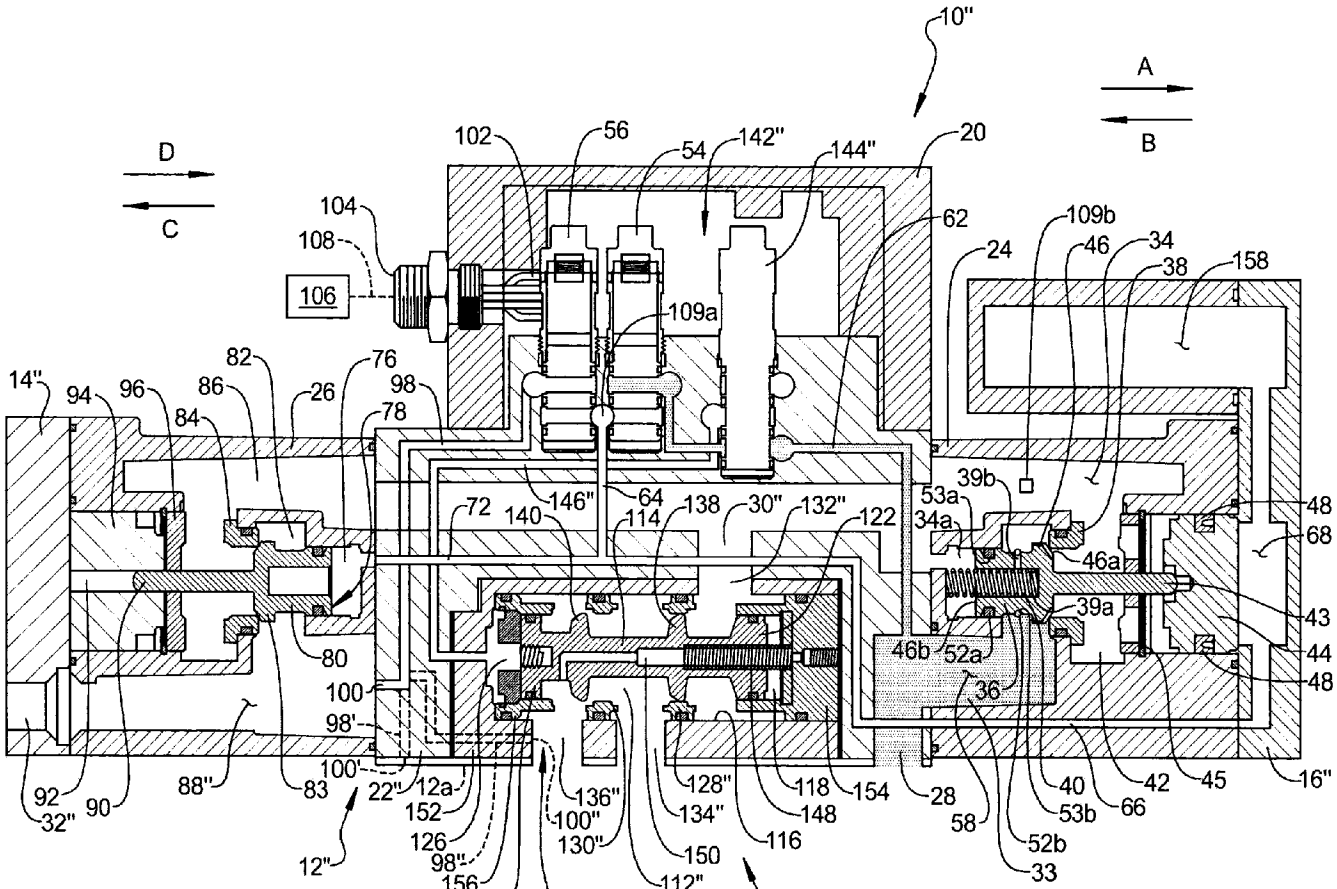
Figure 6B:
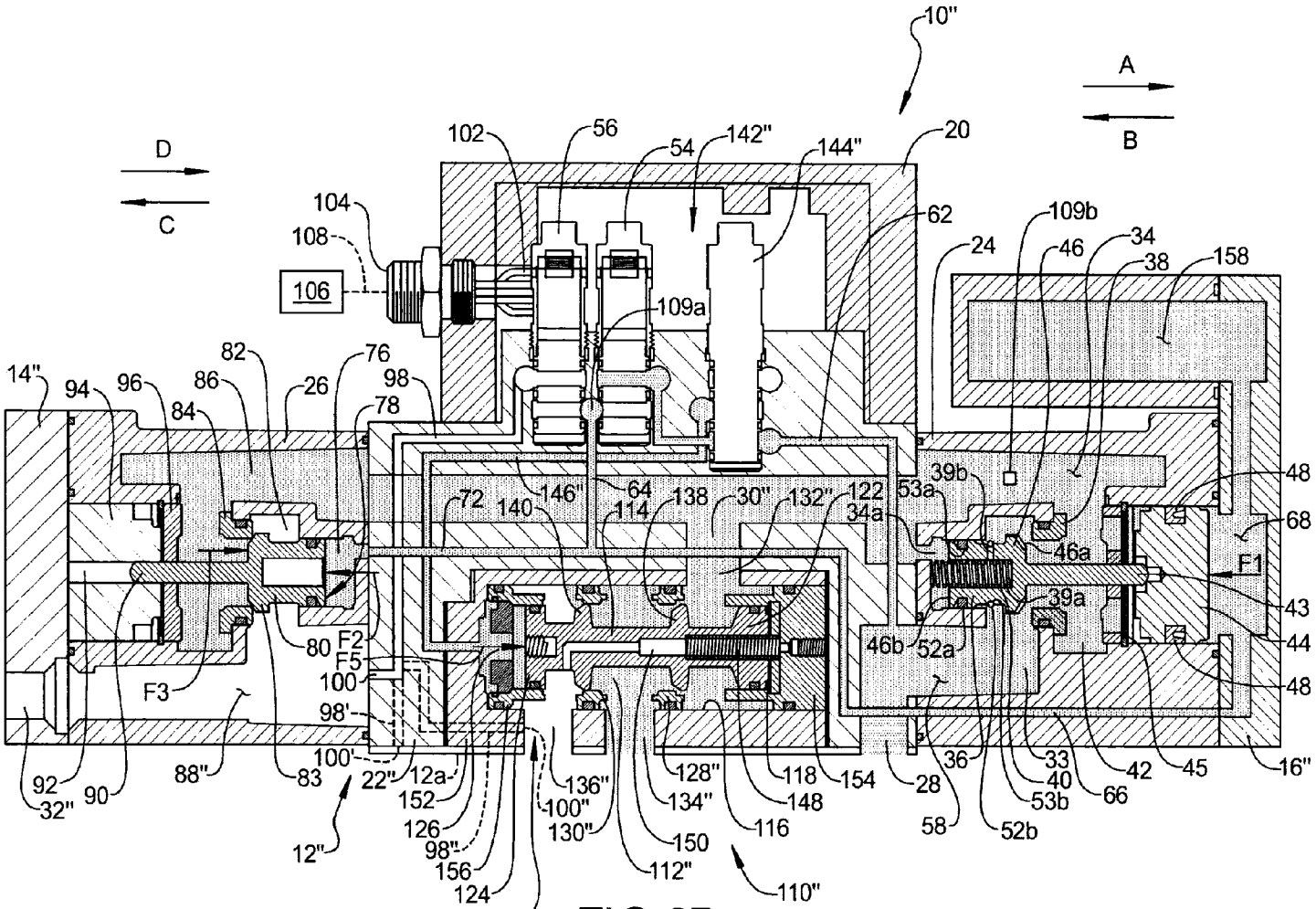
Figure 6C:
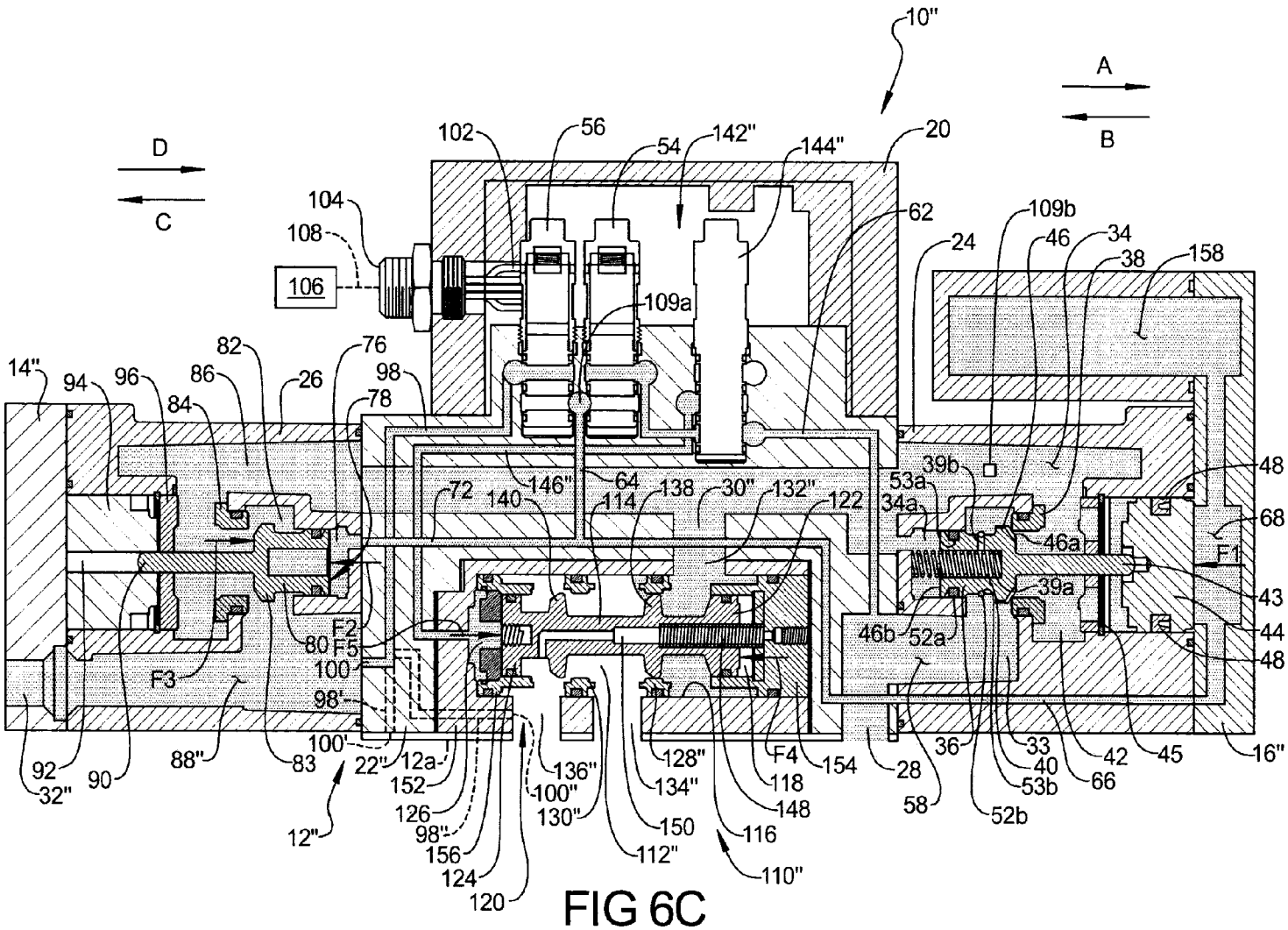

FIG. 2C is another side cross-sectional view of the exemplary proportional pressure controller of FIG. 1 where fluid pressure in an outlet flow passage and an exhaust/outlet common passage in the body of the exemplary proportional pressure controller is being relieved by expelling fluid from the outlet flow passage and the exhaust/outlet common passage through an exhaust flow passage and an exhaust port in the body of the exemplary proportional pressure controller;

FIG. 3 is a side cross-sectional view of another exemplary proportional pressure controller constructed in accordance with the subject disclosure;

FIG. 4A is another side cross-sectional view of the exemplary proportional pressure controller of FIG. 3 where an exemplary isolation valve assembly is preventing fluid from exiting the outlet port in the body of the exemplary proportional pressure controller;

FIG. 4B is another side cross-sectional view of the exemplary proportional pressure controller of FIG. 3 where the exemplary isolation valve assembly is discharging fluid exiting the outlet port in the body of the exemplary proportional pressure controller;

FIG. 4C is another side cross-sectional view of the exemplary proportional pressure controller of FIG. 3 where fluid pressure in the outlet flow passage and the exhaust/outlet common passage in the body of the exemplary proportional pressure controller is being relieved by expelling fluid from the outlet flow passage and the exhaust/outlet common passage through the exhaust flow passage and the exhaust port in the body of the exemplary proportional pressure controller;

FIG. 5 is a side cross-sectional view of another exemplary proportional pressure controller constructed in accordance with the subject disclosure;

FIG. 6A is another side cross-sectional view of the exemplary proportional pressure controller of FIG. 5 where an exemplary isolation valve assembly is preventing fluid from exiting the outlet port in the body of the exemplary proportional pressure controller;

FIG. 6B is another side cross-sectional view of the exemplary proportional pressure controller of FIG. 5 where the exemplary isolation valve assembly is discharging fluid exiting the outlet port in the body of the exemplary proportional pressure controller; and FIG. 6C is another side cross-sectional view of the exemplary proportional pressure controller of FIG. 5 where fluid pressure in the outlet flow passage and the exhaust/outlet common passage in the body of the exemplary proportional pressure controller is being relieved by expelling fluid from the outlet flow passage and the exhaust/outlet common passage through the exhaust flow passage and the exhaust port in the body of the exemplary proportional pressure controller.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a proportional pressure controller 10 includes a body 12 having a first end cap 14 and a second end cap 16 that is oppositely arranged on the body 12 relative to the first end cap 14. The first and second end caps 14, 16 can be releasably fastened or fixedly connected to body 12. A spacer member 18 can also be included with body 12 whose purpose will be discussed in greater detail below. A controller operator 20 can be connected such as by fastening or fixed connection to a central body portion 22. Body 12 can further include an inlet body portion 24 connected between central body portion 22 and spacer member 18, with spacer member 18 positioned between inlet body portion 24 and second end cap 16. Body 12 can further include an exhaust body portion 26 positioned between central body portion 22 and first end cap 14. Optionally, the proportional pressure controller 10 can be provided in the form of a generally rectangular-shaped block such that multiple ones of the proportional pressure controllers 10 can be arranged in a side-by-side configuration. This geometry also promotes use of the proportional pressure controller 10 in a manifold configuration.

According to several embodiments, the inlet and exhaust body portions 24, 26 are releasably and sealingly connected to the central body portion 22. The proportional pressure controller 10 can include each of an inlet port 28, an outlet port 30, and an exhaust port 32 each created in the central body portion 22. A pressurized fluid 33 such as pressurized air can be discharged from the proportional pressure controller 10 via outlet port 30. The outlet port 30 is open to and operably receives the pressurized fluid 33 from an outlet flow passage 34 that is defined within the body 12. The outlet flow passage 34 includes a pressure balancing segment 34*a*. Flow to the outlet flow passage 34 can be isolated using an inlet poppet valve 36. The inlet poppet valve 36 has a longitudinal cavity 39*a* and a vent passageway 39*b*. The inlet poppet valve 36 is normally seated against an inlet valve seat 38 and is held in the seated position shown in FIG. 1 by a biasing member 40 such as a compression spring. When the inlet poppet valve 36 is closed, no fluid flow can pass into the outlet flow passage 34. The biasing member 40 can be held in position by contact with an end wall 41 of inlet body portion 24, and oppositely by being partially received in the longitudinal cavity 39*a* that is defined within the inlet poppet valve 36. Inlet poppet valve 36 is received within an inlet valve cavity 42 in the body 12 such that the inlet poppet valve 36 can axially slide within the inlet valve cavity 42 in each of an inlet valve closing direction "A" extending biasing member 40 and an opposite inlet valve opening direction "B". When the inlet poppet valve 36 moves in the inlet valve opening direction "B", the inlet poppet valve 36 compresses the biasing member 40. An inlet valve stem 43 is integrally connected to the inlet poppet valve 36, extending axially from inlet poppet valve 36. A free end of inlet valve stem 43 contacts a piston 44. Inlet valve stem 43 is slidably disposed through a first boundary wall 45 before contacting piston 44 to help control an axial alignment of inlet poppet valve 36 and to promote a perimeter seal of an inlet poppet seat engagement member 46*a* with inlet valve seat 38 in the closed position. The inlet poppet valve 36 has an opposing face 46*b*, opposite the inlet poppet seat engagement member 46*a*, that faces the pressure balancing segment 34*a* of the outlet flow passage 34. The inlet poppet seat engagement member 46*a* and opposing face 46*b* of the inlet poppet valve 36 have equal surface areas. Accordingly, the inlet poppet valve 36 operates in a pressure balanced condition. Pressurized fluid 33 can free-flow through first boundary wall 45 via at least one hole 47 and/or through the bore that permits passage of inlet valve stem 43. A size and quantity of the at least one hole 47 controls the time required for pressure in outlet flow passage 34 to act on piston 44 and therefore the speed of piston movement. The pressure acting through the at least one hole 47 creates a pressure biasing force acting to move piston 44 toward the closed position. Piston 44 can be provided with at least one, and according to several embodiments, a plurality of resilient U-cup seals 48 which are individually received in individual seal grooves 49 created about a perimeter of piston 44. U-cup seals 48 provide a fluid pressure seal about piston 44 as piston 44 axially slides within a cylinder cavity 50 that is defined within the body 12.

Piston 44 moves coaxially with the inlet poppet valve 36 in inlet valve closing direction "A" or the inlet valve opening direction "B". First boundary wall 45 defines a first boundary (a non-pressure boundary) and piston 44 defines a second boundary (a pressure boundary) of the cylinder cavity 50. Piston 44 can move in the inlet valve opening direction "B" until an end 51 of piston 44 contacts first boundary wall 45, since the first boundary wall 45 is fixed in position. Piston 44 is retained within cylinder cavity 50 by contact with first boundary wall 45 by the previously described pressure biasing force created by pressurized fluid 33 freely flowing through the holes 47. Piston 44 is also retained within cylinder cavity 50 by contact at an opposite end of cylinder cavity 50 with portions of spacer member 18, which extend radially past a cylindrical wall of cylinder cavity 50 as shown in FIG. 1. An elastic seal member 52*a* such as an O-ring can be positioned within a slot or circumferential groove 53*a* created externally about a perimeter of inlet poppet valve 36. Elastic seal member 52*a* seals the inlet poppet valve 36 against the inlet valve cavity 42.

The longitudinal cavity 39*a* in the inlet poppet valve 36 is open to and disposed in fluid communication with the pressure balancing segment 34*a* of the outlet flow passage 34. The vent passageway 39*b* extends between the longitudinal cavity 39*a* and the inlet valve cavity 42. Another elastic seal member 52*b* such as an O-ring can be positioned within a slot or circumferential groove 53*b* created externally about a perimeter of the inlet poppet valve 36. The vent passageway 39*b* opens into circumferential groove 53*b* such that the elastic seal member 52*b* blocks the vent passageway 39*b* and prevents fluid in the inlet valve cavity 42 from entering the vent passageway 39*b*. When pressure in the longitudinal cavity 39*a* of the inlet poppet valve 36 is greater than pressure in the inlet valve cavity 42, the pressure differential slightly expands the elastic seal member 52*b* allowing fluid to flow out from the vent passageway 39*b*. Accordingly, the elastic seal member 52*b* acts as a check valve for the vent passageway 39*b*, allowing fluid to flow through the vent passageway 39*b* in one direction from the longitudinal cavity 39*a* in the inlet poppet valve 36 to the inlet valve cavity 42, but not in the opposite direction (from the inlet valve cavity 42 to the longitudinal cavity 39*a* in the inlet poppet valve 36). Therefore, the vent passageway 39*b* in combination with the elastic seal member 52*b* neutralizes pressure differences between the pressure balancing segment 34*a* of the outlet flow passage 34 and the inlet valve cavity 42.

The proportional pressure controller 10 can be operated using each of a fill valve 54 and a dump valve 56, which can be releasably connected to central body portion 22 within controller operator 20. Pressurized fluid 33 (FIGS. 2A-2C) such as pressurized air received in inlet port 28 may be filtered or purified. Fluid that can back-flow into the proportional pressure controller 10 via outlet port 30 and outlet flow passage 34 is potentially contaminated fluid. According to several embodiments, the fill and dump valves 54, 56 are isolated from the potentially contaminated fluid such that only the filtered, pressurized fluid 33 that is received via the inlet port 28 flows through the fill valve 54 and the dump valve 56. An inlet flow passage 58 communicates the pressurized fluid 33 between inlet port 28 and the inlet valve cavity 42. In other words, the inlet valve cavity 42 connects the inlet flow passage 58 to the outlet flow passage 34. Therefore, the inlet flow passage 58 is fluidly isolated from outlet flow passage 34 by the inlet poppet valve 36, which can be normally closed. A fluid supply port 60 communicates with and is open to the inlet flow passage 58. The fluid supply port 60 leads to a fill inlet passage 62, which is isolated from outlet flow passage 34 and provides pressurized fluid 33 to the fill valve 54. A fill valve discharge passage 64 provides a path for pressurized fluid 33 flowing through the fill valve 54 to be directed to an inlet of dump valve 56 and a plurality of different passages.

One of these passages includes a piston pressurization passage 66, which directs pressurized fluid 33 from the fill valve discharge passage 64 to a piston pressurization chamber 68 created in second end cap 16. Pressurized fluid 33 in the piston pressurization chamber 68 generates a first force F1 (FIG. 2B) acting on a piston end face 70 of piston 44. A surface area of the piston end face 70 is larger than a surface area of the inlet poppet valve 36 that is in contact with inlet valve seat 38, therefore, when the fill valve 54 opens or continues to open further, the net force created by the pressurized fluid 33 acting on the piston end face 70 causes piston 44 to initially move or move further in the inlet valve opening direction "B" and away from inlet valve seat 38. This initially opens the inlet poppet valve 36 or further increases flow through the inlet valve cavity 42 to allow pressurized fluid 33 to flow into the outlet flow passage 34 and exit the proportional pressure controller 10 at the outlet port 30. Therefore, the proportional pressure controller 10 can initiate flow of the pressurized fluid 33 between the inlet port 28 and the outlet port 30 if no flow is present at the outlet port 30, or the proportional pressure controller 10 can maintain, increase, or decrease the pressure of an existing flow of the pressurized fluid 33 between the inlet port 28 and the outlet port 30 in those situations where a continuous, regulated flow of pressurized fluid 33 is required. These operations will be more fully explained below.

A portion of the pressurized fluid 33 that is discharged through the fill valve 54 and then through the fill valve discharge passage 64 is directed via an exhaust valve pressurization passage 72 created in a connecting wall 74 of central body portion 22 into an exhaust valve pressurization chamber 76. When the fill valve 54 is open and the dump valve 56 is closed, the pressurized fluid 33 received in the exhaust valve pressurization chamber 76 via the exhaust valve pressurization passage 72 applies a second force F2 (FIG. 2B) against an exhaust valve end face 78 of an exhaust poppet valve 80 to retain the exhaust poppet valve 80 in a seated position.

The exhaust poppet valve 80 is slidably disposed in an exhaust valve cavity 82 that is defined within the body 12. The exhaust poppet valve 80 includes an exhaust poppet seat engagement member 83, which contacts an exhaust valve seat 84 in the closed position of exhaust poppet valve 80 (shown in FIG. 1). When exhaust poppet valve 80 is in the closed position, the pressurized fluid 33 flowing from outlet flow passage 34 through outlet port 30 also enters an exhaust/outlet common passage 86. In the closed position, the exhaust poppet valve 80 is isolated from the exhaust port 32 to prevent the pressurized fluid 33—from flowing out of exhaust port 32 through an exhaust flow passage 88. Accordingly, the pressurized fluid 33 in the exhaust/outlet common passage 86 applies a third force F3 (FIG. 2B) on the exhaust poppet valve 80 that generally opposes the second force F2 that the pressurized fluid 33 in the exhaust valve pressurization chamber 76 applies to the exhaust valve end face 78 of the exhaust poppet valve 80. The exhaust valve cavity 82 is positioned between and fluidly connects the exhaust/outlet common passage 86 and the exhaust flow passage 88.

The exhaust poppet valve 80 includes an integrally connected, axially extending exhaust valve stem 90, which is slidingly received in a stem receiving passage 92 of a stem receiving member 94. The stem receiving member 94 is positioned between a second boundary wall 96 and the first end cap 14. Similar to the first boundary wall 45, the pressurized fluid 33 can free-flow through second boundary wall 96 via at least one hole 97. A size and quantity of the hole(s) 97 controls the speed at which pressure balances across second boundary wall 96.

A dump valve passage 98 is provided at a discharge side of the dump valve 56, which communicates with the exhaust flow passage 88 via a dump valve exhaust port 100 in the central body portion 22. The dump valve exhaust port 100 is open to the exhaust flow passage 88 and therefore operates to expel the pressurized fluid 33 in the fill valve discharge passage 64 into the exhaust flow passage 88 when the dump valve 56 is actuated. It is noted that dump valve outlet passage 98 is isolated from the exhaust valve pressurization passage 72, the fill valve discharge passage 64, and piston pressurization passage 66 when the dump valve 56 is closed. It is further noted that each of the valve discharge passage 64, the piston pressurization passage 66, the exhaust valve pressurization passage 72, and the dump valve passage 98 are isolated from the pressurized fluid 33 in the outlet flow passage 34 and exhaust/outlet common passage 86 when the fill valve 54 is open. These flow passages therefore allow communication of the filtered, pressurized fluid 33 from the inlet port 28 to be communicated through the fill valve 54 and the dump valve 56 without exposing the fill valve 54 and the dump valve 56 to potentially contaminated fluid lingering around the outlet port 30.

The proportional pressure controller 10 can further include a circuit board 101 positioned inside or outside the controller operator 20, which is in electrical communication with both the fill and dump valves 54, 56. Signals received at the circuit board 101 for positioning control of either the fill or dump valves 54, 56 are received via a wiring harness 102, which may extend through the controller operator 20 and be sealed using a connecting plug 104. A control system 106, which may be external to the controller operator 20, performs calculation functions and forwards command signals to the circuit board 101. The circuit board 101 then controls either/both fill and/or dump valves 54, 56 to control fluid pressure at the outlet port 30. Control signals from and to the proportional pressure controller 10 and the control system 106 are communicated using a control signal interface 108. The control signal interface 108 can be a hard wire (e.g.: wiring harness) connection, a wireless (e.g.: radio frequency or infra-red) connection, or the like. Optionally, the control system 106 may be electrically connected to one or more pressure signaling devices 109*a*, 109*b* via the control signal interface 108. Although the one or more pressure signaling devices 109*a*, 109*b* may be located at various locations in the proportional pressure controller 10, FIG. 1 illustrates a first pressure signaling device 109*a* that is positioned in the fill valve discharge passage 64 and a second pressure signaling device 109*b* that is position in the outlet flow passage 34. In operation, the first and second pressure signaling devices 109*a*, 109*b* respectively measure the fluid pressure within the fill valve discharge passage 64 and the outlet flow passage 34 and generate first and second pressure signals that correspond to the measured fluid pressure. The first and second pressure signaling devices 109*a*,

109*b* output the first and second pressure signals to the control system 106, which controls actuation of the fill valve 54 and the dump valve 56 in response to the first and second pressure signals.

It should be appreciated that failing to achieve the desired fluid pressure at the outlet port 30 of the proportional pressure controller 10 can result in rapid opening/closing operation of the fill and dump valves 54, 56 and the inlet poppet and exhaust poppet valves 36, 80. This condition, which is known as "motor boating", occurs as the proportional pressure controller 10 attempts to correct to the desired fluid pressure at the outlet port 30. Use of the first and second pressure signaling devices 109*a*, 109*b* can provide a differential pressure measurement between the fluid pressure in the fill valve discharge passage 64, which is sensed by first pressure signaling device 109*a*, and the fluid pressure in the outlet flow passage 34, which is sensed by second pressure signaling device 109*b*. Together with fast acting inlet poppet and exhaust poppet valves 35, 38 (which respond to pressure differences and do not require a control signal), the proportional pressure controller 10 can help mitigate the chance of motor boating.

Still referring to FIG. 1, the proportional pressure controller 10 further includes an isolation valve assembly 110. The isolation valve assembly 110 generally comprises an isolation valve cavity 112 and a isolation valve member 114 that is slidably disposed in the isolation valve cavity 112. The isolation valve cavity 112 is defined by a cavity wall 116 and has a first end 118 and a second end 120 that is arranged opposite the first end 118. The isolation valve member 114 is moveable within the isolation valve cavity 112 between an isolation valve closed position (FIG. 2A) and a isolation valve open position (FIG. 2B). The isolation valve assembly 110 includes a first isolation valve piston 122 and a second isolation valve piston 124. The first isolation valve piston 122 is positioned along the isolation valve member 114 such that the first isolation valve piston 122 is slidably disposed within the first end 118 of the isolation valve cavity 112. The second isolation valve piston 124 is positioned along the isolation valve member 114 such that the second isolation valve piston 124 is arranged opposite the first isolation valve piston 122 and is slidably disposed within the second end 120 of the isolation valve cavity 112. Both the first isolation valve piston 122 and the second isolation valve piston 124 seal against the cavity wall 116 of the isolation valve cavity 112. The isolation valve assembly 110 also includes one or more isolation valve pressurization chambers 126*a*, 126*b*. In FIG. 1, one of the isolation valve pressurization chambers 126*a* is open to the first end 118 of the isolation valve cavity 112 while the other isolation valve pressurization chamber 126*b* is open to the second end 120 of the isolation valve cavity 112. As will be explained in greater detail below, fluid pressure within the isolation valve pressurization chambers 126*a*, 126*b* controls the movement and position of the isolation valve member 114 within and relative to the isolation valve cavity 112.

The isolation valve assembly 110 further comprises a first seat member 128 and a second seat member 130. The first and second seat members 128, 130 are disposed along the cavity wall 116 of the isolation valve cavity 112 and are arranged such that the second seat member 130 is longitudinally spaced from the first seat member 128. The isolation valve assembly 110 has an intake port 132, a first discharge port 134, and a second discharge port 136. The intake port 132 is open to the isolation valve cavity 112 and receives an incoming flow of the pressurized fluid 33 during operation of the isolation valve assembly 110. The first discharge port 134 is open to the isolation valve cavity 112 and is positioned longitudinally between the first seat member 128 and the second seat member 130. The second discharge port 136 is also open to the isolation valve cavity 112. The intake port 132 and the second discharge port 136 are positioned longitudinally on opposite sides of the first discharge port 134. In other words, the first discharge port 134 is positioned longitudinally between the intake port 132 and the second discharge port 136.

The isolation valve assembly 110 also includes a first seat engagement member 138 and the second seat engagement member 140. The first and second seat engagement members 138, 140 extend outwardly from the isolation valve member 114 at longitudinally spaced locations. Although other configurations are possible, where the isolation valve cavity 112 is a cylindrical bore (as shown in FIG. 1), the first and second seat engagement members 138, 140 extend radially outward from and annularly about the isolation valve member 114. The first seat engagement member 138 is positioned longitudinally between the first isolation valve piston 122 and the second isolation valve piston 124. The second seat engagement member 140 is positioned longitudinally between the first seat engagement member 138 and the second isolation valve piston 124. It should be appreciated that the first and second seat engagement members 138, 140 and the first and second isolation valve pistons 122, 124 may be integrally formed with the isolation valve member 114 or may be separately formed components that are connected to and carried on the isolation valve member 114. It should also being appreciated that the isolation valve member 114, the first and second isolation valve pistons 122, 124, and the first and second seat engagement members 138, 140 have transverse cross-sections. Where the isolation valve cavity 112 is a cylindrical bore, the transverse cross-sections of the isolation valve member 114, the first and second isolation valve pistons 122, 124, and the first and second seat engagement members 138, 140 may be circular in shape. Generally speaking, the transverse cross-section of the isolation valve member 114 is smaller than the transverse cross-sections of the first and second isolation valve pistons 122, 124 and transverse cross-sections of the first and second seat engagement members 138, 140. The transverse cross-sections of the first and second isolation valve pistons 122, 124 may or may not be equal in size to one another and may or may not be equal in size to the transverse cross-sections of the first and second seat engagement members 138, 140. Likewise, the transverse cross-sections of the first and second seat engagement members 138, 140 may or may not be equal in size to one another.

The proportional pressure controller 10 further includes an actuator 142 for controlling the movement of the isolation valve member 114 between the isolation valve closed position and the isolation valve open position. The actuator 142 may take several forms. In accordance with one exemplary configuration, the actuator 142 includes an actuator valve 144 and an actuator valve passage 146. The actuator valve 144 is arranged in fluid communication with the isolation valve pressurization chambers 126*a*, 126*b*. The actuator valve 144 may also electrically connected to the control system 106 via the control signal interface 108. Therefore, the control system 106 may also control actuation of the actuator valve 144 in response to the first and second pressure signals that the control system 106 receives from the first and second pressure signaling devices. 109*a*, 109*b*. In operation, the actuator valve 144 receives pressurized fluid 33 from the inlet flow passage 58 and selectively pressurizes the isolation valve pressurization chambers 126*a*, 126*b* by selectively supplying the pressurized fluid 33 to the isolation valve pressurization chambers 126*a*, 126*b*. The actuator valve passage 146 extends between the actuator valve 144 and the isolation valve pressurization chambers 126*a*, 126*b* and is therefore configured to communicate pressurized fluid 33 from the actuator valve 144 to the isolation valve pressurization chambers 126*a*, 126*b*.

As will be explained in greater detail below, pressurization of the isolation valve pressurization chambers 126*a*, 126*b* by the actuator valve 144 moves the isolation valve member 114 in the isolation valve cavity 112 between the isolation valve open position and the isolation valve closed position. In the isolation valve closed position, the first seat engagement member 138 that is carried on the isolation valve member 114 contacts the first seat member 128 to fluidly isolate the intake port 132 from the first and second discharge ports 134, 136. In the isolation valve closed position, the second seat engagement member 140 that is carried on the isolation valve member 114 is spaced from the second seat member 130 such that any pressurized fluid 33 at the first discharge port 134 can vent (i.e. be discharged) through the second discharge port 136. In the isolation valve open position, the first seat engagement member 138 that is carried on the isolation valve member 114 is displaced away from the first seat member 128 to permit fluid flow from the intake port 132, through the isolation valve cavity 112, and to the first discharge port 134. In the isolation valve open position, the second seat engagement member 140 that is carried on the isolation valve member 114 contacts the second seat member 130 fluidly isolate the second discharge port 136 from the first discharge port 134.

Various configurations of the proportional pressure controller 10 are possible where either the inlet port 28 or the outlet port 30 in the body 12 of the proportional pressure controller 10 is arranged in fluid communication with either the intake port 132 or the first discharge port 134 of the isolation valve assembly 110. Moreover, the isolation valve assembly 110 can either be located within (i.e. inside of) or external to (i.e. outside of) the body 12 of the proportional pressure controller 10. In the example shown in FIG. 1, the first discharge port 134 of the isolation valve assembly 110 is arranged in fluid communication with the inlet port 28 in the body 12 of the proportional pressure controller 10. In addition, the isolation valve assembly 110 is arranged external to the body 12 of the proportional pressure controller 10. In accordance with this configuration, the isolation valve assembly 110 is used to selectively supply the pressurized fluid 33 to the inlet flow passage 58 in the body 12 of the proportional pressure controller 10 through the inlet port 28. Other alternative configurations will be discussed in greater detail below.

Referring to FIGS. 2A-2C, operation of the proportional pressure controller 10 of FIG. 1 is illustrated. In FIG. 2A, pressurized fluid 33 has been supplied to the intake port 132 of the isolation valve assembly 110. The isolation valve assembly 110 is isolating the pressurized fluid 33 in the intake port 132 from the inlet port 28 and thus the inlet flow passage 58 of the proportional pressure controller 10. Accordingly, the fluid pressure at the outlet port 30 of the proportional pressure controller 10 is zero in FIG. 2A. In FIG. 2A, the actuator valve 144 has supplied the second isolation valve pressurization chamber 126*b* with pressurized fluid 33. The pressurized fluid 33 in the second isolation valve pressurization chamber 126*b* applies a fourth force F4 to the second isolation valve piston 124, which displaces the isolation valve member 114 to the isolation valve closed position. In the isolation valve closed position, the first seat engagement member 138 contacts the first seat member 128 such that the pressurized fluid 33 in the intake port 132 cannot flow to the first or second discharge ports 134, 136. Meanwhile, in the isolation valve closed position, the second seat engagement member 140 is spaced from the second seat member 130 such that any fluid that is present at the first discharge port 134 (i.e. any fluid in the inlet port 28 and the inlet flow passage 58) may be exhausted/expelled through the second discharge port 136.

In FIG. 2B, the pressurized fluid 33 that has been supplied to the intake port 132 of the isolation valve assembly 110 is allowed to flow through the isolation valve assembly 110, through the inlet port 28 in the body 12 of the proportional pressure controller 10, and into the inlet flow passage 58. In FIG. 2B, the actuator valve 144 has supplied the first isolation valve pressurization chamber 126*a* with pressurized fluid 33. The pressurized fluid 33 in the first isolation valve pressurization chamber 126*a* applies a fifth force F5 to the first isolation valve piston 122, which displaces the isolation valve member 114 to the isolation valve open position. In the isolation valve open position, the first seat engagement member 138 is spaced from the first seat member 128 such that the pressurized fluid 33 in the intake port 132 can flow to the first discharge port 134. Meanwhile, in the isolation valve open position, the second seat engagement member 140 contacts the second seat member 130 such that the pressurized fluid 33 that is supplied to the first discharge port 134 by the intake port 132 cannot flow to the second discharge port 136.

As shown in FIG. 2B, the pressurized fluid 33 in the inlet flow passage 58 also flows into the fluid supply port 60 and the fill inlet passage 62. The control system 106 sends a signal to open fill valve 54, with dump valve 56 being retained in a closed position. When fill valve 54 opens, a portion of the pressurized fluid 33 in the inlet port 28 flows through the fill valve 54 and into the fill valve discharge passage 64. The fluid pressure in the fill valve discharge passage 64 is sensed by the first pressure signaling device 109*a*, which according to several embodiments can be a pressure transducer. The pressurized fluid 33 in fill valve discharge passage 64 is directed, in part, through the piston pressurization passage 66 and into the piston pressurization chamber 68. The pressurized fluid 33 in the piston pressurization chamber 68 applies the first force F1 to the piston 44, which causes the piston 44 to slide in the inlet valve opening direction "B". The piston 44 acts against the inlet valve stem 43 to push the inlet poppet valve 36 away from the inlet valve seat 38, compressing the biasing member 40. This opening motion of inlet poppet valve 36 allows the pressurized fluid 33 in the inlet flow passage 58 to flow through the inlet valve cavity 42 and into outlet flow passage 34, and from there, to the outlet port 30. The pressurized fluid which exits the outlet port 30 can be directed to a pressure controlled device (not shown) such as a piston operator or similar actuating device.

The first boundary wall 45 can also function as a contact surface stopping the sliding motion of the piston 44 in the inlet valve opening direction "B". A length of time that the inlet poppet valve 36 is open can be used together with the pressure sensed by the first pressure signaling device 109*a* to proportionally control the fluid pressure at the outlet port 30. Because the first pressure signaling device 109*a* is positioned within the fill valve discharge passage 64, the first pressure signaling device 109*a* is isolated form potential contaminants that may be present in outlet port 30. This reduces the possibility of contaminants affecting the pressure signal of first pressure signaling device 109*a*. As previously noted, when the pressurized fluid 33 is being discharged through the outlet port 30 and when the fill valve 54 is in the open position, some of the pressurized fluid 33 in the fill valve discharge passage 64 passes through the exhaust valve pressurization passage 72 and into the exhaust valve pressurization chamber 76. The pressurized fluid 33 in the exhaust valve pressurization chamber 76 applies the second force F2 to the exhaust valve end face 78 to retain the exhaust poppet valve 80 in the closed position by forcing the exhaust poppet valve 80 in the exhaust valve closing direction "C". As the pressurized fluid 33 flows through the outlet port 30, some of the pressurized fluid 33 flows into the exhaust/outlet common passage 86. The pressurized fluid 33 in the exhaust/outlet common passage 86 applies the third force F3 to the exhaust poppet valve 80. The third force F3 that is applied to the exhaust poppet valve 80 generally opposes the second force F2. Accordingly, in FIG. 2B, the second force F2 is greater than the third force F3 such that the exhaust poppet valve 80 remains closed.

Referring to FIG. 2C, when a desired pressure is reached in the outlet flow passage 34, as sensed by second pressure signaling device 109*b*, the fill valve 54 is directed to close. If the desired pressure is exceeded, the dump valve 56 is directed to open. The dump valve 56 will also be directed to open if a command signal is generated by the control system 106 to lower the fluid pressure in the outlet flow passage 34. When the fill valve 54 is closed, the pressurized fluid 33 in the fill inlet passage 62 is isolated from the fill valve discharge passage 64. When the dump valve 56 opens, the exhaust valve pressurization passage 72 vents to the exhaust flow passage 88 via the fill valve discharge passage 64 and the dump valve outlet passage 98. The residual fluid pressure at the outlet port 30 and the exhaust/outlet common passage 86 therefore exceeds the fluid pressure in the exhaust valve pressurization passage 72, forcing exhaust poppet valve 80 to translate in the exhaust valve opening direction "D". In other words, in FIG. 2C, the second force F2 that is applied to the exhaust valve end face 78 of the exhaust poppet valve 80 by the pressurized fluid 33 in the exhaust valve pressurization chamber 76 is less than the third force F3 that is applied to the exhaust poppet valve 80 by the pressurized fluid 33 in the exhaust/outlet common passage 86. At the same time, the pressurized fluid 33 in the piston pressurization passage 66 vents to the exhaust flow passage 88 via the fill valve discharge passage 64 and the dump valve outlet passage 98. This reduces the first force F1 acting on the piston 44 and thus the inlet poppet valve 36 such that the biasing force of biasing member 40 returns the inlet poppet valve 36 in the inlet valve closing direction "A" to seat the inlet poppet valve 36 against the inlet valve seat 38. The at least one hole 47 provided through the first boundary wall 45 permits fluid pressure equalization across the first boundary wall 45 increasing the sliding speed of the piston 44 when the inlet poppet valve 36 closes.

As the exhaust poppet valve 80 moves in the exhaust valve opening direction "D", the exhaust poppet seat engagement member 83 moves away from the exhaust valve seat 84 allowing the pressurized fluid 33 to flow from the exhaust/outlet common passage 86, through the exhaust valve cavity 82, into the exhaust flow passage 88, and exiting via the exhaust port 32. When the dump valve 56 receives a signal from the control system 106 to close as the fluid pressure at the fill valve discharge passage 64, which is sensed by first pressure signaling device 109*a*, reaches the desired pressure, the exhaust poppet valve 80 will remain in the open position until the fluid pressure in the exhaust valve pressurization chamber 76 exceeds the fluid pressure in the exhaust/outlet common passage 86. When this occurs, fluid pressure in the exhaust valve pressurization passage 72 forces the exhaust poppet valve 80 in the exhaust valve closed direction "C" against the exhaust valve seat 84.

If a zero pressure condition at the outlet 30 is desired, the actuator valve 144 of the isolation valve assembly 110 supplies the second isolation valve pressurization chamber 126*b* with pressurized fluid 33. The pressurized fluid 33 in the second isolation valve pressurization chamber 126*b* applies the fourth force F4 to the second isolation valve piston 124, which returns the isolation valve member 114 to the isolation valve closed position. In the isolation valve closed position, the first seat engagement member 138 contacts the first seat member 128 such that the pressurized fluid 33 in the intake port 132 cannot flow to the first or second discharge ports 134, 136. Meanwhile, in the isolation valve closed position, the second seat engagement member 138 is spaced from the second seat member 130 such that any fluid that is present at the first discharge port 134 (i.e. any fluid in the inlet port 28 and the inlet flow passage 58) may be exhausted/expelled through the second discharge port 136. By cutting off flow of the pressurized fluid 33 to the inlet port 28, the residual pressurized fluid 33 in the outlet flow passage 34, the exhaust/outlet common passage 86, the fill valve discharge passage 64, the piston pressurization passage 66, the piston pressurization chamber 68, the exhaust valve pressurization passage 72, and the exhaust valve pressurization chamber 76 will be exhausted through the exhaust flow passage 88 and the exhaust port 32. This returns the proportional pressure controller 10 to the condition illustrated in FIG. 2A.

With reference to FIG. 3, another proportional pressure controller 10' is shown where the intake port 132' of the isolation valve assembly 110' is arranged in fluid communication with the outlet port 30 in the body 12. In addition to this change, the entire isolation valve assembly 110' has been flipped vertically (i.e. rotated 180 degrees about an axis running co-axially through the first discharge port 134 shown in FIG. 1). In accordance with this configuration, the intake port 132' of the isolation valve assembly 110' receives the pressurized fluid exiting the outlet flow passage 34 and the exhaust/outlet common passage 86 through the outlet port 30 and the first discharge port 134 supplies the pressurized fluid 33 to the pressure controlled device (not shown). The remaining structure of the proportional pressure controller 10' is substantially the same as that described with reference to the proportional pressure controller 10 of FIG. 1. Like in FIG. 1, the isolation valve assembly 110' illustrated in FIG. 3 is external to the body 12 of the proportional pressure controller 10'.

Referring to FIGS. 4A-4C, operation of the proportional pressure controller 10' of FIG. 3 is illustrated. In FIG. 4A, pressurized fluid 33 has been supplied directly to the inlet port 28 and thus the inlet flow passage 58 of the proportional pressure controller 10'. The inlet poppet engagement member 46*a* of the inlet poppet valve 36 is held against the inlet valve seat 38 by the biasing member 40, which acts against the inlet poppet valve 36 in the inlet poppet valve closing direction "A". In FIG. 4A, the actuator valve 144' has supplied the second isolation valve pressurization chamber 126*b* with pressurized fluid 33. The pressurized fluid 33 in the second isolation valve pressurization chamber 126*b* applies the fourth force F4 to the second isolation valve piston 124, which displaces the isolation valve member 114 to the isolation valve closed position. In the isolation valve closed position, the first seat engagement member 138 contacts the first seat member 128 such that any of the residual fluid 33 in the outlet port 30 of the body 12 cannot flow from the intake port 132' of the isolation valve assembly 110' to the first or second discharge ports 134', 136'. Meanwhile, in the isolation valve closed position, the second seat engagement member 140 is spaced from the second seat member 130 such that any fluid that is present at the first discharge port 134' (i.e. any fluid in the pressure controlled device) may be exhausted/expelled through the second discharge port 136'. In this way, a zero pressure condition is provided at the first and second discharge ports 134', 136' of the isolation valve assembly 110'.

As shown in FIG. 4B, the pressurized fluid 33 in the inlet flow passage 58 flows into the fluid supply port 60 and the fill inlet passage 62. The control system 106 sends a signal to open fill valve 54, with dump valve 56 being retained in a closed position. When fill valve 54 opens, a portion of the pressurized fluid 33 in the inlet port 28 flows through the fill valve 54 and into the fill valve discharge passage 64. The fluid pressure in fill valve discharge passage 64 is sensed by the first pressure signaling device 109*a*. The pressurized fluid 33 in fill valve discharge passage 64 is directed, in part, through the piston pressurization passage 66 and into the piston pressurization chamber 68. The pressurized fluid 33 in the piston pressurization chamber 68 applies the first force F1 to the piston 44, which causes the piston 44 to slide in the inlet valve opening direction "B". The piston 44 acts against the inlet valve stem 43 to push the inlet poppet valve 36 away from the inlet valve seat 38, compressing the biasing member 40. This opening motion of inlet poppet valve 36 allows the pressurized fluid 33 in the inlet flow passage 58 to flow through the inlet valve cavity 42 and into outlet flow passage 34, and from there, to the outlet port 30. In addition, some of the pressurized fluid 33 in the fill valve discharge passage 64 passes through the exhaust valve pressurization passage 72 and into the exhaust valve pressurization chamber 76. The pressurized fluid 33 in the exhaust valve pressurization chamber 76 applies the second force F2 to the exhaust valve end face 78 to retain the exhaust poppet valve 80 in the closed position by forcing the exhaust poppet valve 80 in the exhaust valve closing direction "C". As the pressurized fluid 33 flows through the outlet port 30, some of the pressurized fluid 33 flows into the exhaust/outlet common passage 86. The pressurized fluid 33 in the exhaust/outlet common passage 86 applies the third force F3 to the exhaust poppet valve 80. The third force F3 that is applied to the exhaust poppet valve 80 generally opposes the second force F2. Accordingly, in FIG. 4B, the second force F2 is greater than the third force F3 such that the exhaust poppet valve 80 remains closed.

In FIG. 4B, the actuator valve 144' has supplied the first isolation valve pressurization chamber 126*a* with pressurized fluid 33. The pressurized fluid 33 in the first isolation valve pressurization chamber 126*a* applies the fifth force F5 to the first isolation valve piston 122, which displaces the isolation valve member 114 to the isolation valve open position. In the isolation valve open position, the first seat engagement member 138 is spaced from the first seat member 128 such that the pressurized fluid 33 in the intake port 132' can flow to the first discharge port 134'. Meanwhile, in the isolation valve open position, the second seat engagement member 140 contacts the second seat member 130 such that the pressurized fluid 33 that is supplied to the first discharge port 134' by the intake port 132' cannot flow to the second discharge port 136'. Accordingly, in the isolation valve open position, the isolation valve assembly 110' permits the pressurized fluid 33 to exit the outlet port 30, pass through the isolation valve cavity 112, and flow to the pressure controlled device (not shown) via the first discharge port 134'.

Referring to FIG. 4C, when a desired pressure is reached in the outlet flow passage 34, as sensed by second pressure signaling device 109*b*, the fill valve 54 is directed to close. If the desired pressure is exceeded, the dump valve 56 is directed to open. The dump valve 56 will also be directed to open if a command signal is generated by the control system 106 to lower the fluid pressure in the outlet flow passage 34. When the fill valve 54 is closed, the pressurized fluid 33 in the fill inlet passage 62 is isolated from the fill valve discharge passage 64. When the dump valve 56 opens, the exhaust valve pressurization passage 72 vents to the exhaust flow passage 88 via the fill valve discharge passage 64 and the dump valve outlet passage 98. The residual fluid pressure at the outlet port 30 and the exhaust/outlet common passage 86 therefore exceeds the fluid pressure in the exhaust valve pressurization passage 72, forcing exhaust poppet valve 80 to translate in the exhaust valve opening direction "D". In other words, in FIG. 4C, the second force F2 that is applied to the exhaust valve end face 78 of the exhaust poppet valve 80 by the pressurized fluid 33 in the exhaust valve pressurization chamber 76 is less than the third force F3 that is applied to the exhaust poppet valve 80 by the pressurized fluid 33 in the exhaust/outlet common passage 86. At the same time, the pressurized fluid 33 in the piston pressurization passage 66 vents to the exhaust flow passage 88 via the fill valve discharge passage 64 and the dump valve outlet passage 98. This reduces the first force F1 acting on the piston 44 and thus the inlet poppet valve 36 such that the biasing force of biasing member 40 returns the inlet poppet valve 36 in the inlet valve closing direction "A" to seat the inlet poppet valve 36 against the inlet valve seat 38.

As the exhaust poppet valve 80 moves in the exhaust valve opening direction "D", the exhaust poppet seat engagement member 83 moves away from the exhaust valve seat 84 allowing the pressurized fluid 33 to flow from the exhaust/outlet common passage 86, through the exhaust valve cavity 82, into the exhaust flow passage 88, and exiting via the exhaust port 32. When the dump valve 56 receives a signal from the control system 106 to close as the fluid pressure at the fill valve discharge passage 64, which is sensed by first pressure signaling device 109*a*, reaches the desired pressure, the exhaust poppet valve 80 will remain in the open position until the fluid pressure in the exhaust valve pressurization chamber 76 exceeds the fluid pressure in the exhaust/outlet common passage 86. When this occurs, fluid pressure in the exhaust valve pressurization passage 72 forces the exhaust poppet valve 80 in the exhaust valve closed direction "C" against the exhaust valve seat 84.

If a zero pressure condition at the first discharge port 134' is desired (i.e. the pressure supplied to the pressure controlled device), the actuator valve 144' of the isolation valve assembly 110' supplies the second isolation valve pressurization chamber 126*b* with pressurized fluid 33. The pressurized fluid 33 in the second isolation valve pressurization chamber 126*b* applies the fourth force F4 to the second isolation valve piston 124, which returns the isolation valve member 114 to the isolation valve closed position. In the isolation valve closed position, the first seat engagement member 138 contacts the first seat member 128 such that the pressurized fluid 33 in the intake port 132' cannot flow to the first or second discharge ports 134', 136'. Meanwhile, in the isolation valve closed position, the second seat engagement member 138 is spaced from the second seat member 130 such that any fluid that is present at the first discharge port 134' (i.e. any fluid in the pressure controlled device) may be exhausted/expelled through the second discharge port 136'. By isolating the first discharge port 134' from the outlet port 30 and the residual pressurized fluid 33 in the outlet flow passage 34, the isolation valve assembly 110' creates a zero pressure condition at the first discharge port 134', which is connected in fluid communication with the pressure controlled device (not shown).

With reference to FIG. 5 another proportional pressure controller 10" is shown where the intake port 132" of the isolation valve assembly 110 is arranged in fluid communication with and directly adjacent to the outlet port 30" in the body 12". In addition to this change, the isolation valve assembly 110" has been arranged within the body 12" creating a more compact proportional pressure controller 10". In accordance with this configuration, the intake port 132" of the isolation valve assembly 110" receives the pressurized fluid 33 exiting the outlet flow passage 34 and the exhaust/outlet common passage 86 through the outlet port 30". The actuator valve 144" of the actuator 142" has also been moved from a position external to the body 12" to a position that is within the body 12" and the controller operator 20 of the proportional pressure controller 10". The actuator valve 144" is disposed in fluid communication with the fill inlet passage 62 and only one isolation valve pressure chamber 126 in this configuration by way of the actuator valve passage 146". The isolation valve pressure chamber 126 is open to the second end 120 of the isolation valve cavity 112". The other isolation valve pressure chamber at the first end 118 of the isolation valve cavity 112" has been replaced by a isolation valve biasing member 148. By way of example and without limitation, the isolation valve biasing member 148 may be a coil spring. To prevent a vacuum from forming in the first end 118 of the isolation valve cavity 112", the isolation valve member 114" may optionality include a vent passageway 150 that extends through the isolation valve member 114" such that the first end 118 of the isolation valve cavity 112" remains in constant fluid communication with the second discharge port 136".

Although the isolation valve cavity 112" may be defined by the central body portion 22" of the proportional pressure controller 10", in FIG. 5, the isolation valve cavity 112" is defined by an isolation valve cartridge 152, which is received in the central body portion 22" of the proportional pressure controller 10". The first and second seat members 128", 130" may be integral with the isolation valve cartridge 152 or may be separately formed components. As shown in FIG. 5, where the first and second seat members 128", 130" are separately formed components, the first and second seat members 128", 130" may have seals that seal against the isolation valve cartridge 152. Similarly, the first and second isolation valve pistons 122, 124 may seal against the isolation valve cartridge 152 or may seal against first and second isolation valve end caps 154, 156. As shown in FIG. 5, where the first and second isolation valve pistons 122, 124 seal against the first and second isolation valve end caps 154, 156, the first isolation valve end cap 154 is positioned in the first end 118 of the isolation valve cavity 112" between the isolation valve cartridge 152 and the first isolation valve piston 122 while the second isolation valve end cap 156 is positioned in the second end 120 of the isolation valve cavity 112" between the isolation valve cartridge 152 and the second isolation valve piston 124. The first and second isolation valve end caps 154, 156 may also have seals that seal the first and second isolation valve end caps 154, 156 to the isolation valve cartridge 152. The shape of the exhaust flow passage 88" in FIG. 5 has been modified such that the exhaust port 32" now exits through the first end cap 14" of the proportional pressure controller 10". Finally, the second end cap 16" of the proportional pressure controller 10" has been modified to include an accumulator cavity 158 that is disposed in fluid communication with the piston pressurization chamber 68. As such, the accumulator cavity 158 receives pressurized fluid 33 from the piston pressurization chamber 68 when the fill valve 54 is open. The remaining structure of the proportional pressure controller 10" is substantially the same as that described with reference to the proportional pressure controller 10' of FIG. 3.

In accordance with one configuration illustrated in FIG. 5, the dump valve passage 98 may extend between the discharge side of the dump valve 56 and the exhaust flow passage 88". In this configuration, the dump valve exhaust port 100 opens directly into the exhaust flow passage 88". When the dump valve 56 is opened, fluid flows through the dump valve passage 98 and is expelled from the dump valve exhaust port 100 into the exhaust flow passage 88". In an alternative configuration, the proportional pressure controller 10" includes a dump valve passage 98' in the body 12" that extends between the dump valve 56 and a dump valve exhaust port 100' that opens to an outer surface 12*a* of the body 12". When the dump valve 56 is opened, fluid flows through the dump valve passage 98' and is expelled from the body 12" via the dump valve exhaust port 100', which is a standalone port disposed along the outer surface 12*a* of the body 12". In another alternative configuration, the proportional pressure controller 10" includes a dump valve passage 98" in the body 12" that extends between the dump valve 56 and the second discharge port 136" of the isolation valve assembly 110". In this configuration, the dump valve exhaust port 100" opens directly into the second discharge port 136". When the dump valve 56 is opened, fluid flows through the dump valve passage 98" and is expelled from the dump valve exhaust port 100" into one of the second discharge port 136".

Referring to FIGS. 6A-6C, operation of the proportional pressure controller 10" of FIG. 5 is illustrated. In FIG. 6A, pressurized fluid 33 has been supplied directly to the inlet port 28 and thus the inlet flow passage 58 of the proportional pressure controller 10". The inlet poppet engagement member 46*a* of the inlet poppet valve 36 is held against the inlet valve seat 38 by the biasing member 40, which acts against the inlet poppet valve 36 in the inlet poppet valve closing direction "A". As shown in FIG. 6A, the isolation valve member 114" is biased to the isolation valve closed position. More particularly, the isolation valve biasing member 148 applies the fourth force F4 to the first isolation valve piston 122, which pushes the isolation valve member 114" towards the isolation valve closed position. In the isolation valve closed position, the first seat engagement member 138 contacts the first seat member 128" such that any of the residual fluid 33 in the outlet port 30" of the body 12" cannot flow from the intake port 132" of the isolation valve assembly 110" to the first or second discharge ports 134", 136". Meanwhile, in the isolation valve closed position, the second seat engagement member 140 is spaced from the second seat member 130" such that any fluid that is present at the first discharge port 134" (i.e. any fluid in the pressure controlled device) may be exhausted/expelled through the second discharge port 136". In this way, a zero pressure condition is provided at the first and second discharge ports 134", 136" of the isolation valve assembly 110".

As shown in FIG. 6B, the pressurized fluid 33 in the inlet flow passage 58 flows into the fluid supply port 60 and the fill inlet passage 62. The control system 106 sends a signal to open fill valve 54, with dump valve 56 being retained in a closed position. When fill valve 54 opens, a portion of the pressurized fluid 33 in the inlet port 28 flows through the fill valve 54 and into the fill valve discharge passage 64. The fluid pressure in fill valve discharge passage 64 is sensed by the first pressure signaling device 109*a*. The pressurized fluid 33 in fill valve discharge passage 64 is directed, in part, through the piston pressurization passage 66 and into the piston pressurization chamber 68. The pressurized fluid 33 in the piston pressurization chamber 68 applies the first force F1 to the piston 44, which causes the piston 44 to slide in the inlet valve opening direction "B". The piston 44 acts against the inlet valve stem 43 to push the inlet poppet valve 36 away from the inlet valve seat 38, compressing the biasing member 40. This opening motion of inlet poppet valve 36 allows the pressurized fluid 33 in the inlet flow passage 58 to flow through the inlet valve cavity 42 and into outlet flow passage 34, and from there, to the outlet port 30. In addition, some of the pressurized fluid 33 in the fill valve discharge passage 64 passes through the exhaust valve pressurization passage 72 and into the exhaust valve pressurization chamber 76. The pressurized fluid 33 in the exhaust valve pressurization chamber 76 applies the second force F2 to the exhaust valve end face 78 to retain the exhaust poppet valve 80 in its closed position by forcing the exhaust poppet valve 80 in the exhaust valve closing direction "C". As the pressurized fluid 33 flows through the outlet port 30", some of the pressurized fluid 33 flows into the exhaust/outlet common passage 86. The pressurized fluid 33 in the exhaust/outlet common passage 86 applies the third force F3 to the exhaust poppet valve 80. The third force F3 that is applied to the exhaust poppet valve 80 generally opposes the second force F2. Accordingly, in FIG. 6B, the second force F2 is greater than the third force F3 such that the exhaust poppet valve 80 remains closed.

In FIG. 6B, the actuator valve 144" has supplied the isolation valve pressurization chamber 126 with pressurized fluid 33. The pressurized fluid 33 in the first isolation valve pressurization chamber 126 applies a fifth force F5 to the second isolation valve piston 124, which displaces the isolation valve member 114" to the isolation valve open position, compressing the isolation valve biasing member 148. In the isolation valve open position, the first seat engagement member 138 is spaced from the first seat member 128" such that the pressurized fluid 33 in the intake port 132" can flow to the first discharge port 134". Meanwhile, in the isolation valve open position, the second seat engagement member 140 contacts the second seat member 130" such that the pressurized fluid 33 that is supplied to the first discharge port 134" by the intake port 132" cannot flow to the second discharge port 136". Accordingly, in the isolation valve open position, the isolation valve assembly 110" permits the pressurized fluid 33 to exit the outlet port 30", pass through the isolation valve cavity 112", and flow to the pressure controlled device (not shown) via the first discharge port 134".

Referring to FIG. 6C, when a desired pressure is reached in the outlet flow passage 34, as sensed by second pressure signaling device 109*b*, the fill valve 54 is directed to close. If the desired pressure is exceeded, the dump valve 56 is directed to open. The dump valve 56 will also be directed to open if a command signal is generated by the control system 106 to lower the fluid pressure in the outlet flow passage 34. When the fill valve 54 is closed, the pressurized fluid 33 in the fill inlet passage 62 is isolated from the fill valve discharge passage 64. When the dump valve 56 opens, the exhaust valve pressurization passage 72 vents to the exhaust flow passage 88" via the fill valve discharge passage 64 and the dump valve outlet passage 98. The residual fluid pressure at the outlet port 30" and the exhaust/outlet common passage 86 therefore exceeds the fluid pressure in the exhaust valve pressurization passage 72, forcing exhaust poppet valve 80 to translate in the exhaust valve opening direction "D". In other words, in FIG. 6C, the second force F2 that is applied to the exhaust valve end face 78 of the exhaust poppet valve 80 by the pressurized fluid 33 in the exhaust valve pressurization chamber 76 is less than the third force F3 that is applied to the exhaust poppet valve 80 by the pressurized fluid 33 in the exhaust/outlet common passage 86. At the same time, the pressurized fluid 33 in the piston pressurization passage 66 vents to the exhaust flow passage 88" via the fill valve discharge passage 64 and the dump valve outlet passage 98. This reduces the first force F1 acting on the piston 44 and thus the inlet poppet valve 36 such that the biasing force of biasing member 40 returns the inlet poppet valve 36 in the inlet valve closing direction "A" to seat the inlet poppet valve 36 against the inlet valve seat 38.

As the exhaust poppet valve 80 moves in the exhaust valve opening direction "D", the exhaust poppet seat engagement member 83 moves away from the exhaust valve seat 84 allowing the pressurized fluid 33 to flow from the exhaust/outlet common passage 86, through the exhaust valve cavity 82, into the exhaust flow passage 88", and exiting via the exhaust port 32". When the dump valve 56 receives a signal from the control system 106 to close as the fluid pressure at the fill valve discharge passage 64 reaches the desired pressure, the exhaust poppet valve 80 will remain in the open position until the fluid pressure in the exhaust valve pressurization chamber 76 exceeds the fluid pressure in the exhaust/outlet common passage 86. When this occurs, fluid pressure in the exhaust valve pressurization passage 72 forces the exhaust poppet valve 80 in the exhaust valve closed direction "C" against the exhaust valve seat 84.

If a zero pressure condition at the first discharge port 134" is desired (i.e. the pressure supplied to the pressure controlled device), the actuator valve 144" of the isolation valve assembly 110" releases the pressurized fluid 33 from the isolation valve pressurization chamber 126. This relieves the first force F5 that the pressurized fluid 33 in the isolation valve pressurization chamber 126 was applying to the second isolation valve piston 124. As such, the fourth force F4, which the isolation valve biasing member 148 applies to the first isolation valve piston 122, returns the isolation valve member 114 to the isolation valve closed position. In the isolation valve closed position, the first seat engagement member 138 contacts the first seat member 128" such that the pressurized fluid 33 in the intake port 132" cannot flow to the first or second discharge ports 134", 136". Meanwhile, in the isolation valve closed position, the second seat engagement member 138 is spaced from the second seat member 130" such that any fluid that is present at the first discharge port 134" (i.e. any fluid in the pressure controlled device) may be exhausted/expelled through the second discharge port 136". By isolating the first discharge port 134" from the outlet port 30" and therefore the residual pressurized fluid 33 in the outlet flow passage 34, the isolation valve assembly 110" creates a zero pressure condition at the first discharge port 134", which is connected in fluid communication with the pressure controlled device (not shown).

The configurations shown in the Figures are not intended to be limiting. For example, although the inlet poppet valve 36 and the exhaust valve poppet valve 80 are shown in an opposed configuration, these poppet valves can be arranged in any configuration at the discretion of the manufacturer.

Alternate configurations can provide the poppet valves in a side-by-side parallel disposition. The poppet valves can also be oriented such that both poppet valves seat in a same axial direction and unseat in the same opposed axial direction. The configurations shown in the Figures are therefore exemplary of some and not all of the possible configurations available. Similarly, further embodiments of the proportional pressure controller may include different types of valves for the fill valve 54, the dump valve 56, and the actuator valve 144. For example, one or more of the fill valve 54, the dump valve 56, and the actuator valve 144 can be hydraulically operated, solenoid operated, or air operated valves, which can provide different operating characteristics.

Proportional pressure controllers of the present disclosure offer several advantages. By eliminating solenoid actuators associated with the main flow valves of the controller and replacing the valves with poppet valves, small and lower energy consumption pilot valves in the form of fill and dump valves are used to provide pressure actuation to open or close the poppet valves. This reduces the cost and operating power required for the proportional pressure controller. The use of passageways created in the body of the proportional pressure controller to transfer pressurized fluid to actuate the poppet valves (which are isolated from the main poppet valve flow paths) prevents potentially contaminated fluid at the outlet of the proportional pressure controller from backflowing into the pilot valves, which could inhibit their operation. One of the passageways can be used to simultaneously provide pressure to open one of the poppet valves while holding the second poppet valve in a closed position. By positioning a pressure sensing device in one of the isolated passageways, the pressure sensing device is also isolated from contaminants to improve the accuracy of the device's pressure signal. In addition, the proportional pressure controllers of the present disclosure operate to create a zero pressure condition at either the outlet port in the body of the proportional pressure controller or at the first discharge port of the isolation valve assembly. Beneficially, either the outlet port in the body of the proportional pressure controller or the first discharge port of the isolation valve assembly is configured to supply the pressurized fluid to a pressure controlled device, which may require the zero pressure condition during at least part of its operation.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A proportional pressure controller, comprising:

a body having an inlet flow passage, an outlet flow passage, an exhaust/outlet common passage, and an exhaust flow passage;

an inlet port in the body that opens to the inlet flow passage;

an outlet port in the body that opens to the outlet flow passage and the exhaust/outlet common passage;

an exhaust port in the body that opens to the exhaust flow passage;

an inlet valve cavity in the body connecting the inlet flow passage and the outlet flow passage;

an inlet poppet valve slidably disposed in the inlet valve cavity that is operable to control fluid flow between the inlet flow passage and the outlet flow passage;

an exhaust valve cavity in the body connecting the exhaust/outlet common passage and the exhaust flow passage;

an exhaust poppet valve slidably disposed in the exhaust valve cavity that is operable to control fluid flow between the exhaust/outlet common passage and the exhaust flow passage;

an isolation valve assembly integrated into the body of the proportional pressure controller, the isolation valve assembly including an isolation valve cavity disposed in said body in fluid communication with the outlet port and an isolation valve member slidably disposed in the isolation valve cavity, the isolation valve member being movable between an isolation valve closed position and an isolation valve open position; and an actuator controlling movement of the isolation valve member between the isolation valve closed position and the isolation valve open position;

wherein the isolation valve member prevents fluid from flowing through the outlet port when the isolation valve member is in the isolation valve closed position and permits fluid flow through the outlet port when the isolation valve member is in the isolation valve open position.

2. The proportional pressure controller of claim 1, wherein the isolation valve cavity is defined by a cavity wall that is formed in the body and wherein the isolation valve cavity has a first end and a second end that is opposite the first end.

3. The proportional pressure controller of claim 2, wherein the isolation valve assembly includes:

first and second seat members disposed along the cavity wall of the isolation valve cavity, the second seat member being longitudinally spaced from the first seat member;

an intake port disposed in fluid communication with the outlet port in the housing such that the intake port of the isolation valve assembly is operable to receive fluid from the outlet flow passage and the exhaust/outlet common passage through the outlet port;

a first discharge port that is positioned longitudinally between the first seat member and the second seat member;

a second discharge port, the intake port and the second discharge port being positioned on longitudinally opposite sides of the first discharge port; and first and second seat engagement members extending outwardly from the isolation valve member at longitudinally spaced locations.

4. The proportional pressure controller of claim 3, wherein the first seat engagement member of the isolation valve member contacts the first seat member when the isolation valve member is in the isolation valve closed position to fluidly isolate the intake port from the first and second discharge ports.

5. The proportional pressure controller of claim 3, wherein the first seat engagement member of the isolation valve member is displaced away from the first seat member to permit fluid flow from the intake port, through the isolation valve cavity, and to the first discharge port and wherein the second seat engagement member of the isolation valve member contacts the second seat member when the isolation valve member is in the isolation valve open position to fluidly isolate the second discharge port from the first discharge port.

6. The proportional pressure controller of claim 3, wherein the isolation valve assembly includes:

a first isolation valve piston positioned along the isolation valve member such that the first isolation valve piston is slidably disposed within the first end of the isolation valve cavity, the first seat engagement member being positioned longitudinally along the isolation valve member between the first isolation valve piston and the second seat engagement member; and a second isolation valve piston positioned along the isolation valve member such that the second isolation valve piston is opposite the first isolation valve piston and is slidably disposed within the second end of the isolation valve cavity, the second seat engagement member being positioned longitudinally along the isolation valve member between the second isolation valve piston and the first seat engagement member.

7. The proportional pressure controller of claim 3, wherein the isolation valve assembly further includes an isolation valve pressurization chamber that is open to the first end of the isolation valve cavity and wherein the actuator includes an actuator valve and an actuator valve passage, the actuator valve arranged in fluid communication with the inlet flow passage and the isolation valve pressurization chamber, the actuator valve operable to receive fluid from the inlet flow passage and pressurize the isolation valve pressurization chamber by supplying the fluid to the isolation valve pressurization chamber, and the actuator valve passage extending between the actuator valve and the isolation valve pressurization chamber for communicating the fluid from the actuator valve to the isolation valve pressurization chamber.

8. The proportional pressure controller of claim 7, wherein the isolation valve member is biased to the isolation valve closed position and pressurization of the isolation valve pressurization chamber by the actuator valve operably moves the isolation valve member to the isolation valve open position.

9. The proportional pressure controller of claim 3, wherein the isolation valve assembly further comprises a vent passageway extending through the isolation valve member such that the first end of the isolation valve cavity remains in constant fluid communication with the second discharge port.

10. The proportional pressure controller of claim 3, further comprising:

a cylinder cavity in the body disposed adjacent the inlet valve cavity; and a piston slidably disposed in the cylinder cavity and arranged in contact the inlet poppet valve such that displacement of the piston within the cylinder cavity causes movement the inlet poppet valve within the inlet valve cavity.

11. The proportional pressure controller of claim 10, further comprising:

a piston pressurization chamber in the body that is open to the cylinder cavity; and a fill valve arranged in fluid communication with the inlet flow passage and the piston pressurization chamber, the fill valve operable to receive fluid from the inlet flow passage and pressurize the piston pressurization chamber by supplying the fluid to the piston pressurization chamber;

wherein the fluid supplied to the piston pressurization chamber is operable to exert a first force on the piston such that the piston is displaced within the cylinder cavity and moves the inlet poppet valve when the fill valve pressurizes the piston pressurization chamber.

12. The proportional pressure controller of claim 11, further comprising:

an exhaust valve pressurization chamber in the body that is open to the exhaust valve cavity;

wherein the fill valve is arranged in fluid communication with the exhaust valve pressurization chamber and the fill valve is operable to pressurize the exhaust valve pressurization chamber by supplying the fluid to the exhaust valve pressurization chamber;

wherein the fluid supplied to the exhaust valve pressurization chamber is operable to exert a second force on the exhaust poppet to hold the exhaust poppet valve closed.

13. The proportional pressure controller of claim 12, further comprising:

a fill inlet passage in the body that extends between the inlet flow passage and the fill valve for communicating the fluid from the inlet flow passage to the fill valve; and a fill valve discharge passage in the body that extends between the fill valve, the piston pressurization chamber, and the exhaust valve pressurization chamber for communicating the fluid from the fill valve to the piston pressurization chamber and the exhaust valve pressurization chamber.

14. The proportional pressure controller of claim 13, further comprising:

a dump valve arranged in fluid communication with the fill valve discharge passage and the exhaust flow passage, the dump valve operable to direct the fluid in the fill valve discharge passage to the exhaust flow passage such that fluid pressure in the fill valve discharge passage, the piston pressurization chamber, and the exhaust valve pressurization chamber is reduced when the dump valve is actuated.

15. The proportional pressure controller of claim 14, further comprising:

a dump valve passage in the body that extends between the dump valve and the exhaust flow passage for communicating the fluid from the dump valve to the exhaust flow passage.

16. The proportional pressure controller of claim 14, further comprising:

a dump valve passage in the body that extends between the dump valve and a dump valve exhaust port that opens to an outer surface of the body.

17. The proportional pressure controller of claim 14, further comprising:

a dump valve passage in the body that extends between the dump valve and the second discharge port of the isolation valve assembly.

18. The proportional pressure controller of claim 14, wherein the reduction in fluid pressure in the piston pressurization chamber caused by actuation of the dump valve operably relieves the first force from the piston.

19. The proportional pressure controller of claim 14, wherein the reduction in fluid pressure in the piston pressurization chamber caused by actuation of the dump valve operably relieves the second force from the exhaust poppet valve allowing the exhaust poppet valve to open in response to a third force exerted on the exhaust poppet valve by fluid in the exhaust/outlet common passage of the body.

20. The proportional pressure controller of claim 14, further including:

a first pressure signaling device positioned in the fill valve discharge passage that is operable to output a first pressure signal; and a control system electrically connected to the first pressure signaling device that is operable to receive the first pressure signal from the first pressure signaling device and control actuation of the fill valve, the dump valve, and the actuator valve in response to the first pressure signal.

21. The proportional pressure controller of claim 20, further including:

a second pressure signaling device positioned in the outlet flow passage that is operable to output a second pressure signal, the second pressure signaling device electrically connected to the control system such that the control system is operable to receive the second pressure signal from the second pressure signaling device and control actuation of the fill valve, the dump valve, and the actuator valve in response to both the first pressure signal from the first pressure signaling device and the second pressure signal from the second pressure signaling device.

22. A proportional pressure controller, comprising:

a body having an inlet flow passage, an outlet flow passage, an exhaust/outlet common passage, and an exhaust flow passage;

an inlet port in the body that opens to the inlet flow passage;

an outlet port in the body that opens to the outlet flow passage and the exhaust/outlet common passage;

an exhaust port in the body that opens to the exhaust flow passage;

an inlet valve cavity in the body connecting the inlet flow passage and the outlet flow passage;

an inlet poppet valve slidably disposed in the inlet valve cavity that is operable to control fluid flow between the inlet flow passage and the outlet flow passage;

an exhaust valve cavity in the body connecting the exhaust/outlet common passage and the exhaust flow passage;

an exhaust poppet valve slidably disposed in the exhaust valve cavity that is operable to control fluid flow between the exhaust/outlet common passage and the exhaust flow passage;

an isolation valve assembly integrated into the body of the proportional pressure controller, the isolation valve assembly including:

an isolation valve cavity disposed in said body in fluid communication with the outlet port and between the inlet valve cavity and the exhaust valve cavity; and an isolation valve member slidably disposed in the isolation valve cavity, the isolation valve member being movable between an isolation valve closed position and an isolation valve open position; and an actuator controlling movement of the isolation valve member between the isolation valve closed position and the isolation valve open position;

wherein the isolation valve member prevents fluid from flowing through the outlet port when the isolation valve member is in the isolation valve closed position and permits fluid flow through the outlet port when the isolation valve member is in the isolation valve open position.

23. A proportional pressure controller, comprising:

a body including an inlet body portion, an exhaust body portion, and a central body portion that is positioned longitudinally between the inlet body portion and the exhaust body portion, the body having an inlet flow passage disposed in the inlet body portion, an outlet flow passage extending between the inlet body portion and the central body portion, an exhaust/outlet common passage extending between the central body portion and the exhaust body portion, and an exhaust flow passage disposed in the exhaust body portion;

an inlet port in the inlet body portion that opens to the inlet flow passage;

an outlet port in the central body portion that opens to the outlet flow passage and the exhaust/outlet common passage;

an exhaust port in the exhaust body portion that opens to the exhaust flow passage;

an inlet valve cavity in the inlet body portion connecting the inlet flow passage and the outlet flow passage;

an inlet poppet valve slidably disposed in the inlet valve cavity that is operable to control fluid flow between the inlet flow passage and the outlet flow passage;

an exhaust valve cavity in the exhaust body portion connecting the exhaust/outlet common passage and the exhaust flow passage;

an exhaust poppet valve slidably disposed in the exhaust valve cavity that is operable to control fluid flow between the exhaust/outlet common passage and the exhaust flow passage;

an isolation valve assembly integrated into the central body portion, the isolation valve assembly including an isolation valve cavity disposed in said central body portion in fluid communication with the outlet port and an isolation valve member slidably disposed in the isolation valve cavity, the isolation valve member being movable between an isolation valve closed position and an isolation valve open position; and an actuator controlling movement of the isolation valve member between the isolation valve closed position and the isolation valve open position;

wherein the isolation valve member prevents fluid from flowing through the outlet port when the isolation valve member is in the isolation valve closed position and permits fluid flow through the outlet port when the isolation valve member is in the isolation valve open position.

* * * * *